US010268143B2

(12) United States Patent
Tanaka et al.

(10) Patent No.: US 10,268,143 B2
(45) Date of Patent: Apr. 23, 2019

(54) DRIVE DEVICE AND IMAGE FORMING APPARATUS INCORPORATING THE DRIVE DEVICE

(71) Applicants: Kimihiro Tanaka, Kanagawa (JP); Kenji Tomita, Tokyo (JP); Yohei Miura, Tokyo (JP); Kentaro Uji, Kanagawa (JP)

(72) Inventors: Kimihiro Tanaka, Kanagawa (JP); Kenji Tomita, Tokyo (JP); Yohei Miura, Tokyo (JP); Kentaro Uji, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/848,082

(22) Filed: Dec. 20, 2017

(65) Prior Publication Data

US 2018/0181030 A1 Jun. 28, 2018

(30) Foreign Application Priority Data

Dec. 22, 2016 (JP) ..... 2016-249650

(51) Int. Cl.
*G03G 15/16* (2006.01)
*G03G 15/20* (2006.01)
*G03G 21/18* (2006.01)

(52) U.S. Cl.
CPC ..... *G03G 15/1615* (2013.01); *G03G 15/2064* (2013.01); *G03G 21/1857* (2013.01);
(Continued)

(58) Field of Classification Search
CPC ..... G03G 15/1615; G03G 15/6573; G03G 15/6579; G03G 21/1857; G03G 21/186;
(Continued)

(56) References Cited

U.S. PATENT DOCUMENTS 5,126,789 A * 6/1992 Fukuchi ..... G03G 21/1853 271/162
2008/0219728 A1* 9/2008 Lee ..... G03G 15/2035 399/330

(Continued)

FOREIGN PATENT DOCUMENTS

JP 2000-250315 9/2000
JP 2007-009969 1/2007

(Continued)

*Primary Examiner* — Benjamin R Schmitt
(74) *Attorney, Agent, or Firm* — Harness, Dickey & Pierce, P.L.C.

(57) ABSTRACT

A drive device, which is included in an image forming apparatus, includes a drive source, a drive switching device configured to switch between a transmission state and a halting state, a first rotary body having a rotary shaft, a first drive transmission passage through which a driving force is transmitted to the first rotary body, a second rotary body, a second drive transmission passage through which the driving force is transmitted to the second rotary body, a drive transmission body rotatably mounted on the rotary shaft of the first rotary body, and an input drive transmission body mounted on the rotary shaft of the first rotary body and configured to input the driving force to the rotary shaft of the first rotary body, the input drive transmission body configured to rotate together with the drive transmission body as a single unit.

11 Claims, 12 Drawing Sheets

(52) U.S. Cl.
CPC ..... *G03G 2215/00139* (2013.01); *G03G 2221/1657* (2013.01)

(58) Field of Classification Search
CPC ..... G03G 2215/00413; G03G 2215/00417; G03G 2215/0043; G03G 2215/00438; G03G 2221/165
USPC ..... 399/68, 122, 397, 401
See application file for complete search history.

(56) References Cited

U.S. PATENT DOCUMENTS

| | | | | |
|---|---|---|---|---|
| 2016/0091838 | A1* | 3/2016 | Mizuno ..... | G03G 15/1615 399/167 |
| 2017/0343937 | A1 | 11/2017 | Tomita et al. | |

FOREIGN PATENT DOCUMENTS

| | | |
|---|---|---|
| JP | 2016-108135 | 6/2016 |
| JP | 2016-133140 | 7/2016 |

* cited by examiner

DRIVE DEVICE AND IMAGE FORMING APPARATUS INCORPORATING THE DRIVE DEVICE

CROSS-REFERENCE TO RELATED APPLICATION

This patent application is based on and claims priority pursuant to 35 U.S.C. § 119(a) to Japanese Patent Application No. 2016-249650, filed on Dec. 22, 2016, in the Japan Patent Office, the entire disclosure of which is hereby incorporated by reference herein.

BACKGROUND

Technical Field

This disclosure relates to a drive device and an image forming apparatus incorporating the drive device.

Related Art

Various types of drive devices include a first drive transmission passage through which a driving force is transmitted to a first rotary body via a drive transmission cutting device and a second drive transmission passage through which a driving force is transmitted to a second rotary body. Such drive devices include a drive transmission member disposed on the second drive transmission passage. The drive transmission member is rotatably supported by a rotary shaft to which a driving force is inputted via the drive transmission cutting device.

A known drive device includes an input gear having external teeth, a distribution gear having external teeth and a transmission gear having external teeth, which are mounted on the rotary shaft. The input gear has external teeth and functions as an input drive transmission member to input a driving force to the rotary shaft via a drive transmission cutting device. The distribution gear has external teeth and is meshed with the external teeth of the input gear. Accordingly, the driving force applied by a drive motor is transmitted to the distribution gear. The transmission gear has the external teeth and functions as a drive transmission member to be meshed with the distribution gear. Specifically, the distribution gear has a predetermined length in an axial direction of the distribution gear. The transmission gear and the input gear are meshed with the distribution gear at different positions. Then, the distribution gear transmits the driving force to the input gear and the driving force to the transmission gear.

SUMMARY

At least one aspect of this disclosure provides a drive device including a drive source, a drive switching device, a first rotary body, a first drive transmission passage, a second rotary body, a second drive transmission passage, a drive transmission body, and an input drive transmission body. The drive source has having a drive output body. The drive switching device is configured to switch between a transmission state in which a driving force applied by the drive source is transmitted and a halting state in which transmission of the driving force of the drive source is halted. The first rotary body has having a rotary shaft to which the driving force is inputted via the drive switching device. The first drive transmission passage is a passage through which the driving force is transmitted to the first rotary body. The second drive transmission passage is a passage through which the driving force is transmitted to the second rotary body. The drive transmission body is rotatably mounted on the rotary shaft of the first rotary body. The input drive transmission body is mounted on the rotary shaft of the first rotary body and configured to input the driving force to the rotary shaft of the first rotary body. The input drive transmission body is configured to rotate together with the drive transmission body as a single unit.

Further, at least one aspect of this disclosure provides an image forming apparatus including multiple rotary bodies configured to convey a recording medium, and the above-described drive device configured to transmit the driving force to the multiple rotary bodies.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
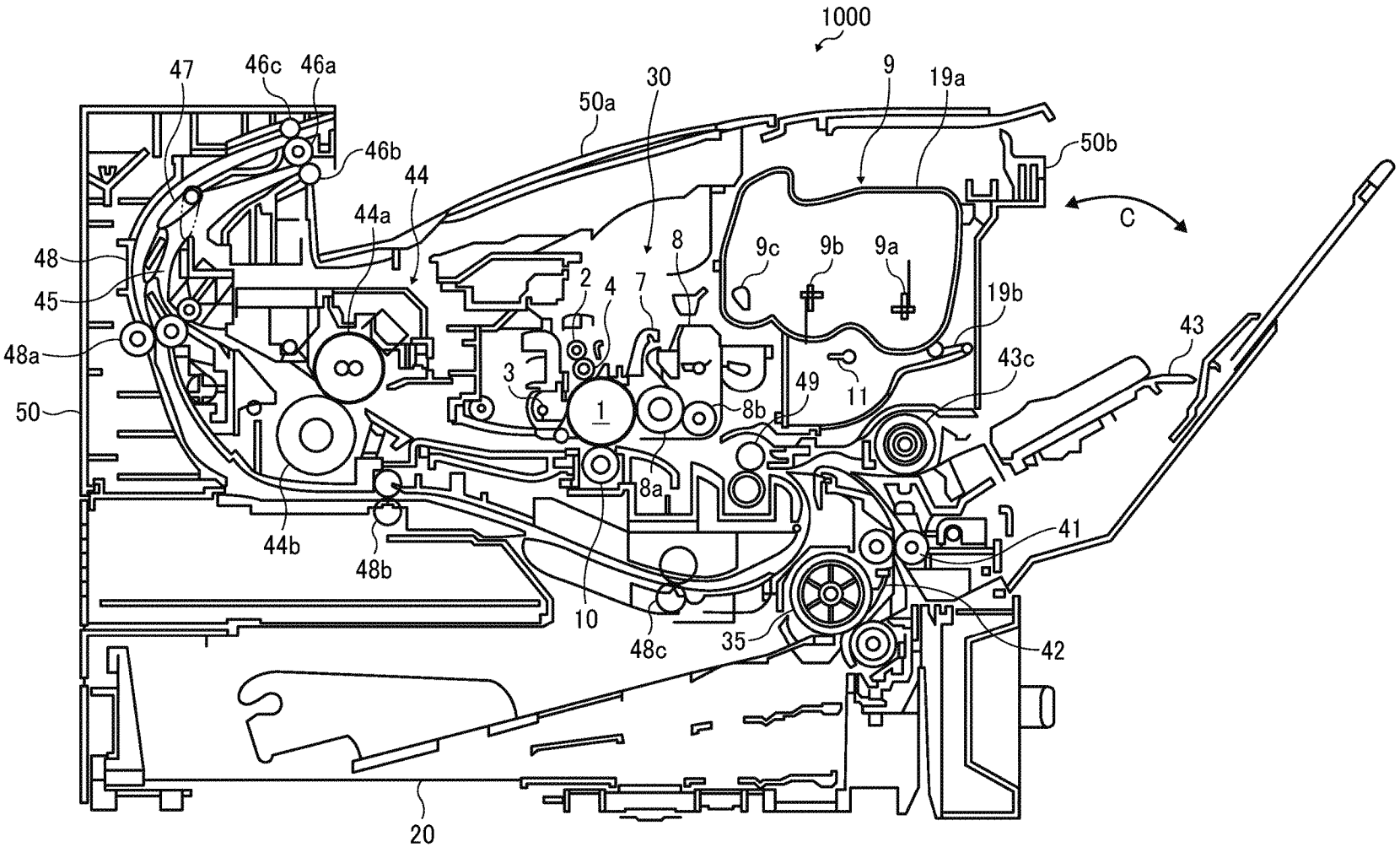
FIG. 1 is a schematic diagram illustrating an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of an electrophotographic image forming apparatus 1000 for forming images by electrophotography.

At first, a description is given of a basic configuration of the image forming apparatus 1000 according to an embodiment of this disclosure, with reference to FIG. 1.

FIG. 1 is a schematic diagram illustrating the image forming apparatus 1000 according to an embodiment of this disclosure.

It is to be noted that identical parts are given identical reference numerals and redundant descriptions are summarized or omitted accordingly.

The image forming apparatus 1000 may be a copier, a facsimile machine, a printer, a multifunction peripheral or a multifunction printer (MFP) having at least one of copying, printing, scanning, facsimile, and plotter functions, or the like. According to the present example, the image forming apparatus 1000 is an electrophotographic printer that prints toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the image forming apparatus 1000 according to the present embodiment of this disclosure includes an apparatus body 50, a photoconductor 1, and a sheet tray 20. The photoconductor 1 functions as a latent image bearer. The sheet tray 20 functions as a sheet container that is detachably attachable to the apparatus body 50. The sheet tray 20 contains a bundle of sheets that function as recording media including a sheet.

The sheet of the sheet bundle contained in the sheet tray 20 is fed from the sheet tray 20 by rotation of a sheet feed roller 35 toward a sheet conveyance passage 42. Thereafter, the sheet is held by a first pair of sheet conveying rollers 41 in a sheet conveyance nip region formed between rollers thereof and conveyed from an upstream side toward a downstream side in the sheet conveying direction through the sheet conveyance passage 42.

Thereafter, the sheet is held by a first pair of sheet conveying rollers 41 in a sheet conveyance nip region formed between rollers thereof and conveyed from an upstream side toward a downstream side in the sheet conveying direction through the sheet conveyance passage 42. Conveyance of the sheet is temporarily stopped in a state in which the leading end of the sheet contacts a registration nip region formed between rollers of the pair of registration rollers 49. While the sheet is in contact with the registration nip region of the pair of registration rollers 49, skew of the sheet is corrected.

The pair of registration rollers 49 starts rotating again to feed the sheet toward a transfer nip region in synchronization with movement of a toner image formed on the surface of the photoconductor 1, so that the toner image is timely transferred from the surface of the photoconductor 1 onto the sheet in the transfer nip region. At this time, the first pair of sheet conveying rollers 41 starts rotating at the same time as the start of rotation of the pair of registration rollers 49, so that conveyance of the sheet that has been halted is resumed.

The apparatus body 50 of the image forming apparatus 1000 supports a bypass tray unit including a bypass tray 43 and a bypass sheet feed roller 43*c*. The sheet that is loaded on the bypass tray 43 of the bypass tray unit is fed from the bypass tray 43 with rotation of the bypass sheet feed roller 43*c*. After passing through a sheet separation nip region in which the bypass sheet feed roller 43*c* and a sheet separation pad contact with each other, the sheet enters an upstream region located upstream from the pair of registration rollers 49 in the sheet conveying direction in the sheet conveyance passage 42. Thereafter, in the same manner as the sheet fed from the sheet tray 20, the sheet passes through the pair of registration rollers 49 before reaching the transfer nip region.

The photoconductor 1 is a drum-shaped photoconductor that rotates in a counterclockwise direction in FIG. 1. There are image forming devices disposed around the photoconductor 1. Specifically the image forming devices are a charging roller 4, a latent image writing device 7, a developing device 8, a transfer roller 10, and a cleaning blade 2.

The charging roller 4 includes a conductive rubber roller and forms a charging nip region by rotating while contacting the photoconductor 1. The charging roller 4 is applied with a charging bias that is output from a power source. Thus, in the charging nip region, an electrical discharge is induced between the surface of the photoconductor 1 and the surface of the charging roller 4. As a result, the surface of the photoconductor 1 is uniformly charged.

The latent image writing device 7 includes an LED (light-emitting diode) array and performs light scanning with LED light over the surface of the photoconductor 1 that has been uniformly charged. Of a ground surface of the photoconductor 1 that has been uniformly charged, the area having been subjected to the light irradiation through this light scanning attenuates the electric potential therein. This results in formation of an electrostatic latent image on the surface of the photoconductor 1.

As the photoconductor 1 rotates, the electrostatic latent image passes through a development region that formed between the surface of the photoconductor 1 and the developing device 8 when the photoconductor 1 is brought to face the developing device 8. The developing device 8 includes a developer container and a developing portion. The developer container includes developer that contains non-magnetic toner and magnetic carrier. The developer container includes a developing roller 8*a* and a screw 8*b* to convey the developer to be supplied to the developing roller 8*a*.

The developing roller 8*a* includes a developing sleeve and a magnet roller. The rotatable developing sleeve is a tubular-shaped rotatable non-magnetic member. The magnet roller is fixed to the developing sleeve in such a way as not to rotate together with the developing sleeve. Part of the developer that is conveyed by the screw 8*b* is scooped up by the surface of the developing sleeve due to a magnetic force generated by the magnet roller. The developer that is carried onto the surface of the developing sleeve passes through an opposing position at which the developing sleeve and a doctor blade are disposed facing each other. At this time, the thickness of a layer of the developer on the surface of the developing sleeve is regulated while the developer is rotated together with rotation of the surface of the development sleeve. Thereafter, the developing roller 8*a* moves while sliding on the surface of the photoconductor 1 in a development region in which the developing roller 8*a* is brought to face the photoconductor 1.

A development bias having the same polarity as the toner and as an electric potential in the surface of the photoconductor 1 is applied to the developing sleeve. The absolute value of this development bias is greater than the absolute value of the electric potential of the latent image and is smaller than the absolute value of the electric potential in the ground surface of the photoconductor 1. Therefore, in the development region, a development potential acts between the developing sleeve of the developing device 8 and the electrostatic latent image formed on the photoconductor 1 in such a way as to electrostatically move the toner from the developing sleeve to the electrostatic latent image. By contrast, a background potential acts between the development sleeve of the developing device 8 and the ground surface of the photoconductor 1 to electrostatically move the toner from the background surface to the developing sleeve. This causes the toner to selectively adhere to the electrostatic latent image formed on the surface of the photoconductor 1, so that the electrostatic latent image is developed in the development region.

A toner cartridge 9 is disposed above the developing device 8. The toner cartridge 9 includes a toner container unit 19*a* and a waste toner collecting unit 19*b*. The toner container unit 19*a* stores toner therein. The waste toner collecting unit 19*b* collects waste toner. The toner container unit 19*a* includes agitators 9*a* and 9*b* and a toner supply member 9*c*. The agitators 9*a* and 9*b* stir toner contained in the toner container unit 19*a*. The toner supply member 9*c* supplies the toner contained in the toner container unit 19*a* to the developing device 8. As the toner supply member 9*c* rotates according to a toner supply signal that is output from a controller, the toner contained in the toner container unit 19*a* is supplied by an amount according to the amount of rotation of the toner supply member 9*c*, to the developing device 8.

The toner image formed on the surface of the photoconductor 1 as a result of the development by the developing device 8 enters the transfer nip region where the photoconductor 1 and the transfer roller 10 that functions as a transfer device contact each other as the photoconductor 1 rotates. A charging bias having the opposite polarity to the latent image electric potential of the photoconductor 1 is applied to the transfer roller 10. Accordingly, an electric field is formed in the transfer nip region.

As described above, the pair of registration rollers 49 conveys the sheet toward the transfer nip region in synchronization with movement of the toner image formed on the photoconductor 1, so that the toner image formed on the photoconductor 1 is transferred onto the sheet in the transfer nip region. Due to the transfer electric field and the nip pressure, as the sheet is closely contacted to the toner image formed on the photoconductor 1 at the transfer nip region, the toner image is transferred onto the sheet.

Residual toner that is not transferred onto the sheet remains on the surface of the photoconductor 1 that has passed through the transfer nip region. The residual toner is scraped off from the surface of the photoconductor 1 by the cleaning blade 2 that is in contact with the photoconductor 1 and, thereafter, is conveyed toward an outside of a unit casing by the collection screw 3. The residual toner that has been discharged from the unit casing is conveyed by a toner conveying device to the waste toner collecting unit 19*b* of the toner cartridge 9. The waste toner collecting unit 19*b* includes a waste toner collection screw 11 to regulate the waste toner collected in the waste toner collecting unit 19*b*.

The surface of the photoconductor 1 that is cleaned by the cleaning blade 2 that functions as a cleaner is electrically discharged by an electric discharging device. Thereafter, the surface of the photoconductor 1 is uniformly charged again by the charging roller 4.

In FIG. 1, the sheet that has passed through the transfer nip region formed by the photoconductor 1 and the transfer roller 10 contacting each other is conveyed to a fixing device 44. The fixing device 44 includes a fixing roller 44*a* and a pressure roller 44*b*. The fixing roller 44*a* includes a heat generating source such as a halogen lamp. The pressure roller 44*b* is pressed against the fixing roller 44*a*. The fixing roller 44*a* and the pressure roller 44*b* contact each other to form a fixing nip region. The toner image is fixed to the surface of the sheet that is held in the fixing nip region due to application of heat and pressure.

The image forming apparatus 1000 performs a single-side printing mode and a duplex printing mode by switching the modes. In the single-side printing mode, the image forming apparatus 1000 produces an image on one side of the sheet. By contrast, the image for apparatus 1000 prints respective images on both sides of the sheet. In the single-side printing mode or in the duplex printing mode when images are formed on both sides of the sheet, a switching claw 47 is located at a position with a solid line in FIG. 1.

After passing through the fixing device 44 and a sheet output passage 45, the sheet is held between a sheet reversing and discharging roller 46*a* and a sheet ejecting roller 46*b*. Then, the sheet is output and stacked in a sheet stacking portion 50*a* that is provided on an upper face of the apparatus body 50 of the image forming apparatus 1000.

By contrast, in the duplex printing mode when an image is formed on one side of the sheet, the switching claw 47 is rotated to a position with a dotted line in FIG. 1. After passing through the fixing device 44 and a sheet output passage 45, the sheet is guided to a reversed sheet conveyance passage 48, so that the sheet is held between the sheet reversing and discharging roller 46*a* and a sheet reverse roller 46*c*. Consequently, the sheet reversing and discharging roller 46*a* is reversely rotated at a time when the leading end of the sheet to a sheet reverse nip region that is formed by the sheet reversing and discharging roller 46*a* and the sheet reverse roller 46*c*. At this time, the switching claw 47 is rotated from the position with the dotted line in FIG. 1 to the position with the solid line in FIG. 1.

After starting a reverse motion along with the reverse rotation of the sheet reversing and discharging roller 46*a*, the sheet is conveyed by a first sheet reentry roller 48*a*, a second sheet reentry roller 48*b* and a third sheet reentry roller 48*c*, which are provided in the reversed sheet conveyance passage 48. Thereafter, the sheet is conveyed again to the registration nip region of the pair of registration rollers 49. Then, after a toner image has been formed on the other side of the sheet in the transfer nip region, the sheet passes through the fixing device 44 and the sheet output passage 45. The sheet is then ejected by the sheet reversing and discharging roller 46*a* and the sheet ejecting roller 46*b*, to the outside of the apparatus body 50 of the image forming apparatus 1000.

The image forming apparatus 1000 further includes a cover 50*b* on a right side face of the apparatus body 50. The cover 50*b* opens and closes in a direction indicated by arrow C in FIG. 1. By opening the cover 50*b*, the toner cartridge 9 can be detached from and attached to the apparatus body 50 through the opening area.

Further, the photoconductor 1, the charging roller 4, the developing device 8 and the cleaning blade 2 are included in a single unit as a process cartridge 30. The process cartridge 30 is detachably attached to the apparatus body 50 of the image forming apparatus 1000. By opening the cover 50*b*, the process cartridge 30 can be detached from and attached to the apparatus body 50 through the opening area. Specifically, when the process cartridge 30 is detached from the apparatus body 50, the process cartridge 30 is removed from the apparatus body 50, together with the toner cartridge 9.

Figure 2:
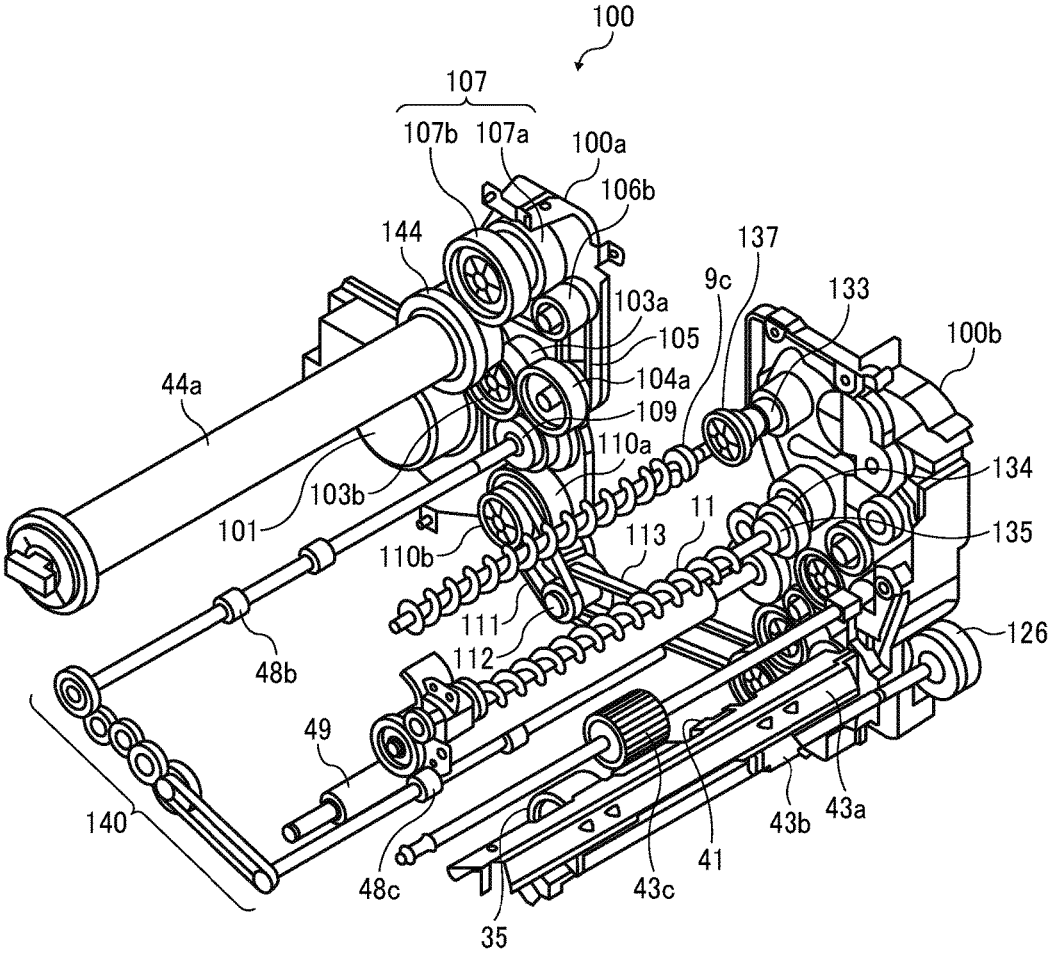
FIG. 2 is a perspective view illustrating a drive device included in the image forming apparatus and a rotary member driven by the drive device.
Figure 3:
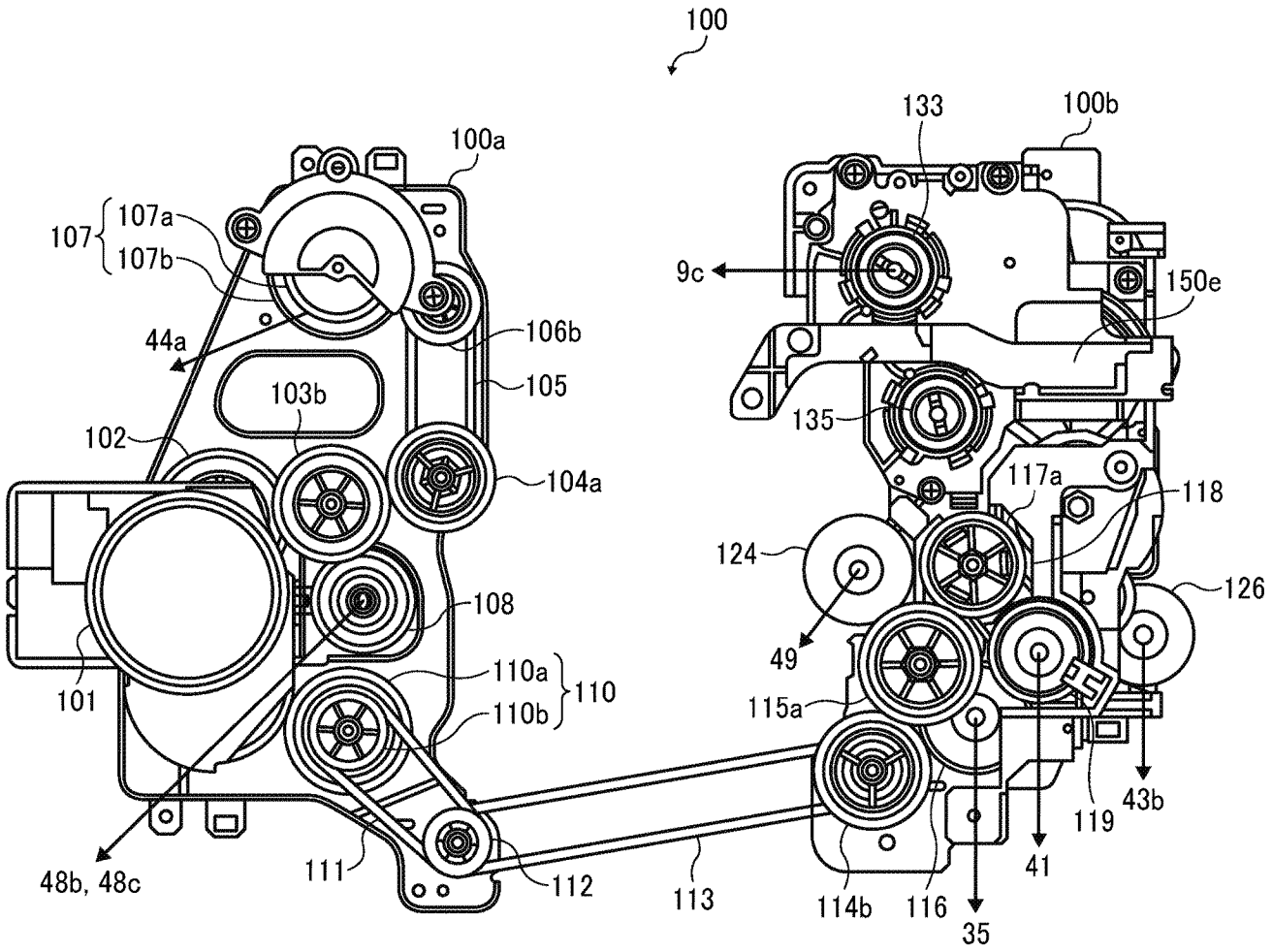
FIG. 3 is a front view illustrating the drive device.
Figure 4:
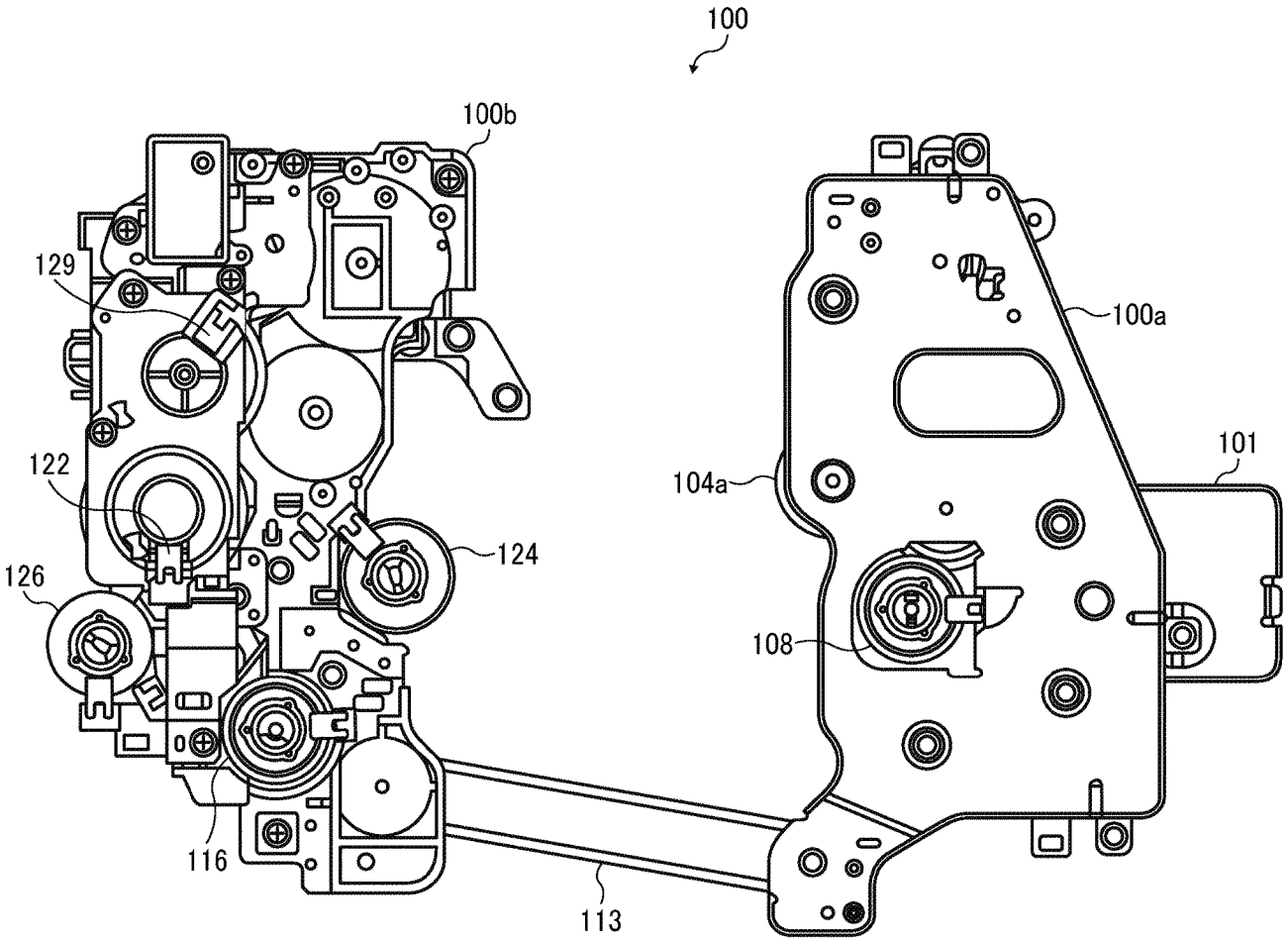
FIG. 4 is a rear view illustrating the drive device.
Figure 5:
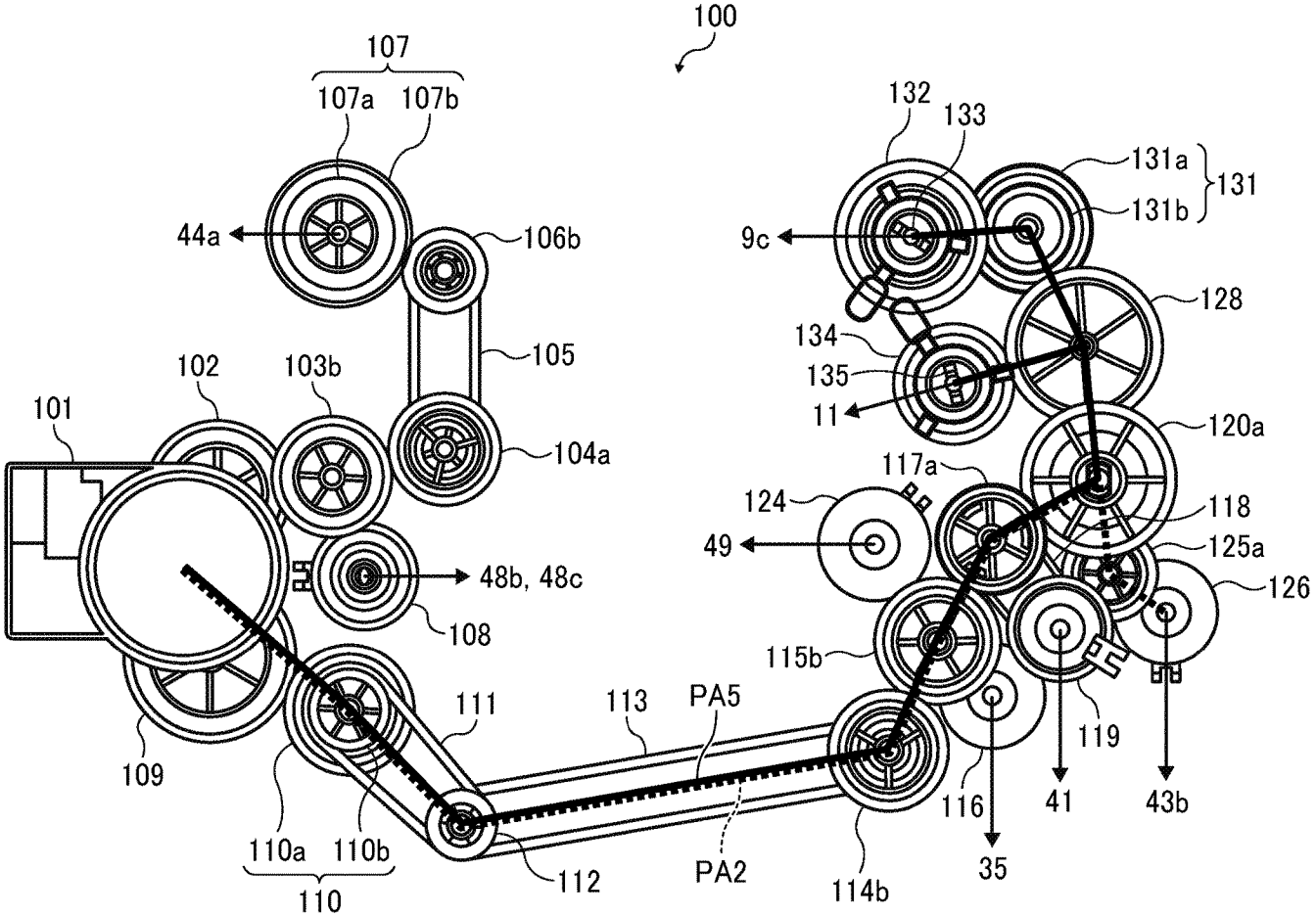
FIG. 5 is a front view illustrating drive transmission members of the drive device.
Figure 6:
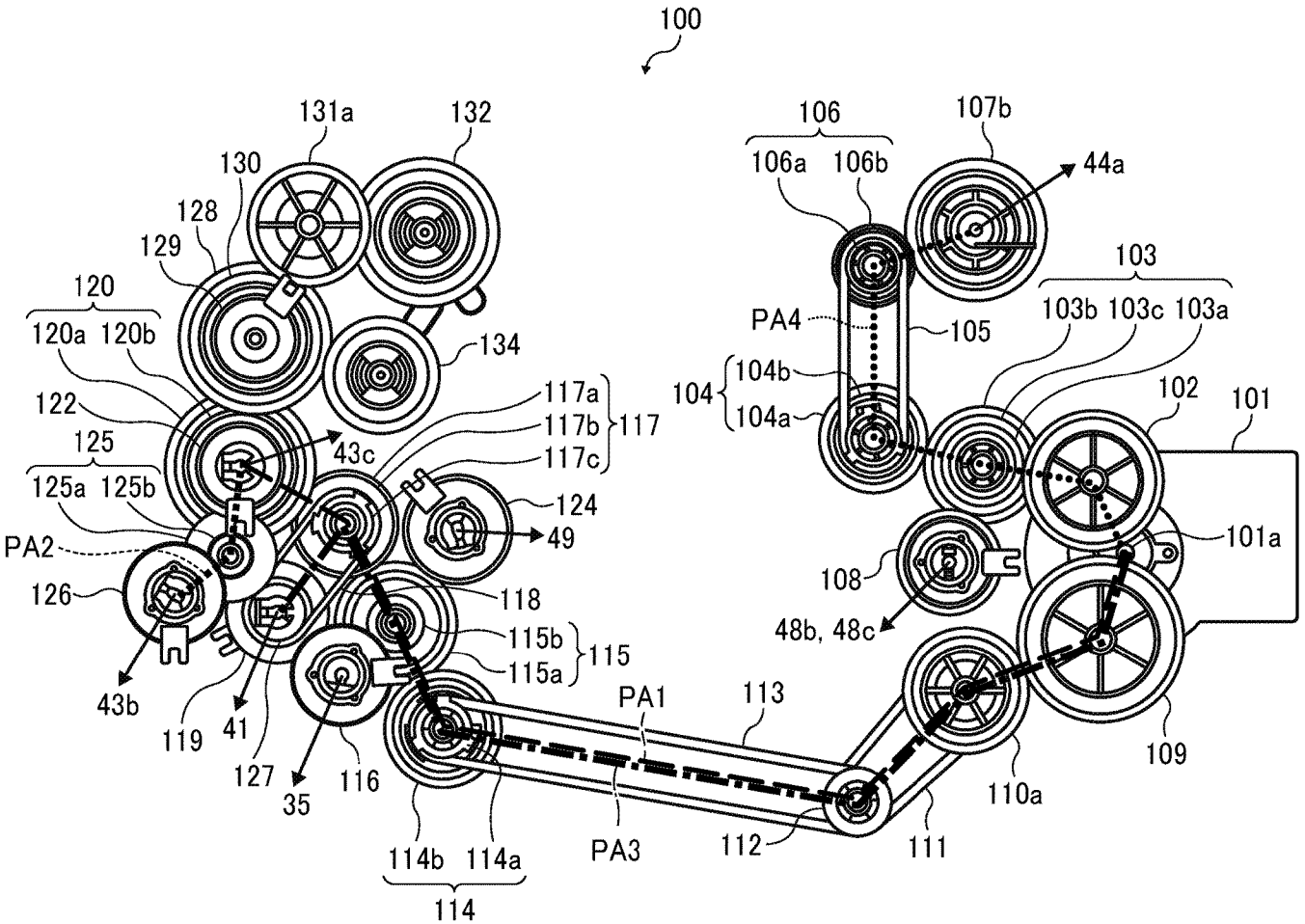
FIG. 6 is a rear view illustrating the drive transmission members of the drive device.

FIG. 2 is a perspective view illustrating a drive device 100 included in the image forming apparatus 1000 and a rotary member driven by the drive device 100. FIG. 3 is a front view illustrating the drive device 100. FIG. 4 is a rear view illustrating the drive device 100. FIG. 5 is a front view illustrating drive transmission members of the drive device 100. FIG. 6 is a rear view illustrating the drive transmission members of the drive device 100.

The drive device 100 rotates the fixing roller 44*a*, the second sheet reentry roller 48*b*, the third sheet reentry roller 48*c*, the pair of registration rollers 49, the first pair of sheet conveying rollers 41, the sheet feed roller 35 and the bypass sheet feed roller 43*c*. The drive device 100 also rotates the agitators 9*a* and 9*b* and the toner supply member 9*c* of the toner cartridge 9 and the waste toner collection screw 11. The drive device 100 also drives an elevating member 43*b* that causes a base plate 43*a* of the bypass tray 43 to ascend or descend.

The drive device 100 includes a sheet ejection side bracket 100*a* and a sheet feed side bracket 100*b*. The sheet ejection side bracket 100*a* holds the drive transmission members arranged on the sheet ejection side with the photoconductor 1 as a starting point. The sheet feed side bracket 100*b* holds drive transmission members arranged on the sheet feed side.

The sheet ejection side bracket 100*a* holds a drive motor 101, drive transmission members for transmitting a driving force to the fixing roller 44*a*, and drive transmission members for transmitting a driving force to each of the second sheet reentry roller 48*b* and the third sheet reentry roller 48*c*.

The sheet feed side bracket 100*b* holds the drive transmission members for transmitting a driving force to each of the pair of registration rollers 49, the first pair of sheet conveying rollers 41, the sheet feed roller 35 and a drive transmission member for transmitting a driving force to the bypass sheet feed roller 43*c*. The sheet feed side bracket 100*b* also holds the drive transmission members for transmitting a driving force to each of the agitators 9*a* and 9*b* and the toner supply member 9*c* of the toner cartridge 9, the waste toner collection screw 11, and the elevating member

43*b*. The drive transmission from the drive transmission members held by the sheet ejection side bracket 100*a* to the drive transmission members held by the sheet feed side bracket 100*b* is performed through a link timing belt 113.

The drive motor 101 that functions as a drive source includes a motor gear 101*a* that is meshed with a first branching gear 102 and a second sheet reentry roller 48*b*. The first branching gear 102 transmits a driving force to each of the fixing roller 44*a*, the second sheet reentry roller 48*b* and the third sheet reentry roller 48*c*. The second branching gear 109 transmits a driving force to the drive transmission members of the sheet feed side bracket 100*b*.

The first branching gear 102 meshes with a fixing reentry input gear 103*a* of a fixing reentry branching gear 103. The fixing reentry branching gear 103 includes a reentry input gear 103*c* and a fixing input gear 103*b*. The reentry input gear 103*c* meshes with a gear of a reentry electromagnetic clutch 108. The fixing input gear 103*b* meshes with a first fixing gear 104*a* of a first fixing drive transmission member 104.

The reentry electromagnetic clutch 108 is mounted on one end of the shaft of the second sheet reentry roller 48*b*. At the other end of the shaft of the second sheet reentry roller 48*b*, a gear that is included in a reentry drive transmission passage 140 is mounted. The gear transmits the driving force to the third sheet reentry roller 48*c*.

When the reentry electromagnetic clutch 108 is OFF, that is, not activated, the gear of the reentry electromagnetic clutch 108 idles to the shaft of the second sheet reentry roller 48*b* and the drive transmission to the shaft of the second sheet reentry roller 48*b* is blocked. At the time of starting reverse rotation driving of the sheet reversing and discharging roller 46*a*, the reentry electromagnetic clutch 108 is switched from OFF to ON, that is activated. Then, the driving force is transmitted to the second sheet reentry roller 48*b* via the reentry electromagnetic clutch 108, thereby rotating the second sheet reentry roller 48*b*.

The driving force is also transmitted to the third sheet reentry roller 48*c* via the second sheet reentry roller 48*b* and the reentry drive transmission passage 140, thereby rotating the third sheet reentry roller 48*c*. When the leading end of the sheet that has been conveyed in the reversed sheet conveyance passage 48 contacts the pair of registration rollers 49, the reentry electromagnetic clutch 108 is switched from ON to OFF. Consequently, the driving of the second sheet reentry roller 48*b* and the third sheet reentry roller 48*c* is temporarily stopped. Then, the pair of registration rollers 49 is driven and the reentry electromagnetic clutch 108 is turned on at the time when the sheet is conveyed to the transfer nip region. Consequently,the driving of the second sheet reentry roller 48*b* and the third sheet reentry roller 48*c* is resumed. When the sheet is ejected to the outside of the apparatus body 50 of the image forming apparatus 1000, the reentry electromagnetic clutch 108 is turned off to stop the driving of the second sheet reentry roller 48*b* and the third sheet reentry roller 48*c*.

The first fixing drive transmission member 104 includes the first fixing gear 104*a* that meshes with the fixing input gear 103*b* of the fixing reentry branching gear 103. The first fixing drive transmission member 104 also includes a first fixing pulley 104*b*. A fixing timing belt 105 is stretched between a first fixing pulley 104*b* and a second fixing pulley 106*a* of a second fixing drive transmission member 106. The second fixing drive transmission member 106 includes the second fixing pulley 106*a* and a second fixing gear 106*b*. The second fixing gear 106*b* meshes with an input gear portion 107*a* of a third fixing drive transmission member 107. The third fixing drive transmission member 107 includes an output gear portion 107*b*. The output gear portion 107*b* meshes with a fixing final gear 144 mounted on the fixing roller 44*a*.

The driving force of the drive motor 101 is transmitted to the first fixing drive transmission member 104 through the first branching gear 102 and the fixing reentry branching gear 103. Further, the driving force is transmitted from the first fixing drive transmission member 104 to the second fixing drive transmission member 106 through the fixing timing belt 105. The driving force is then transmitted to the fixing roller 44*a* through the third fixing drive transmission member 107 and the fixing final gear 144, thereby rotating the fixing roller 44*a*.

The second branching gear 109 meshes with a sheet ejection side output gear 110*a* of a sheet ejection side drive output member 110. The sheet ejection side drive output member 110 includes a sheet ejection side pulley 110*b*. A sheet ejection side timing belt 111 is stretched between the sheet ejection side pulley 110*b* and a relay pulley 112. The link timing belt 113 is wound around the relay pulley 112. The link timing belt 113 is stretched between the relay pulley 112 and a sheet feed side input pulley 114*a* of a sheet feed side drive input member 114 that is held by the sheet feed side bracket 100*b*.

The driving force of the drive motor 101 is transmitted to the relay pulley 112 through the second branching gear 109, the sheet ejection side drive output member 110 and the sheet ejection side timing belt 111. Further, the driving force is transmitted to the sheet feed side drive input member 114 through the relay pulley 112 and the link timing belt 113. Consequently, the driving force of the drive motor 101 is transmitted to the sheet feed side bracket 100*b*.

The sheet feed side drive input member 114 includes a sheet feed side input gear 114*b*. The sheet feed side input gear 114*b* meshes with a first idler gear 115*a* of a first sheet feed branch drive member 115. The first sheet feed branch drive member 115 includes a sheet feed branch gear 115*b* that meshes with a gear of a sheet feed electromagnetic clutch 116 that is mounted on the shaft of the sheet feed roller 35. The first idler gear 115*a* of the first sheet feed branch drive member 115 meshes with a gear of a registration electromagnetic clutch 124 and a second idler gear 117*a* of a second sheet feed branch drive member 117.

The driving force of the drive motor 101 transmitted to the sheet feed side drive input member 114 is transmitted to each of the sheet feed electromagnetic clutch 116 and the registration electromagnetic clutch 124 through the first sheet feed branch drive member 115. When the sheet set on the sheet tray 20 is fed, the sheet feed electromagnetic clutch 116 is turned ON to transmit the driving force to the sheet feed roller 35 through the sheet feed electromagnetic clutch 116, thereby rotating the sheet feed roller 35. Accordingly, the sheet set on the sheet tray 20 is fed to the sheet conveyance passage 42 by the sheet feed roller 35. When the leading end of the sheet fed by the sheet feed roller 35 contacts the pair of registration rollers 49, the sheet feed electromagnetic clutch 116 is turned OFF simultaneously, to interrupt the rotation of the sheet feed roller 35.

The registration electromagnetic clutch 124 is turned ON when the sheet can be overlaid on the toner image formed on the photoconductor 1 in the transfer nip transfer nip region, thereby rotating the pair of registration rollers 49. After the trailing edge of the sheet has passed through the pair of registration rollers 49, the registration electromagnetic clutch 124 is turned OFF to interrupt driving of the pair of registration rollers 49.

As described above, the second sheet feed branch drive member 117 includes the second idler gear 117*a* that meshes with the first idler gear 115*a* of the first sheet feed branch drive member 115. The second sheet feed branch drive member 117 further includes a bypass supply output gear 117*b* and a first conveyance pulley 117*c*. A sheet conveyance timing belt 118 is stretched between the first conveyance pulley 117*c* and a second conveyance pulley 127 that is rotatably supported on the shaft of the first pair of sheet conveying rollers 41. A conveyance electromagnetic clutch 119 is attached to the shaft of the first pair of sheet conveying rollers 41. The conveyance electromagnetic clutch 119 is drivingly coupled to the second conveyance pulley 127.

Figure 7A:
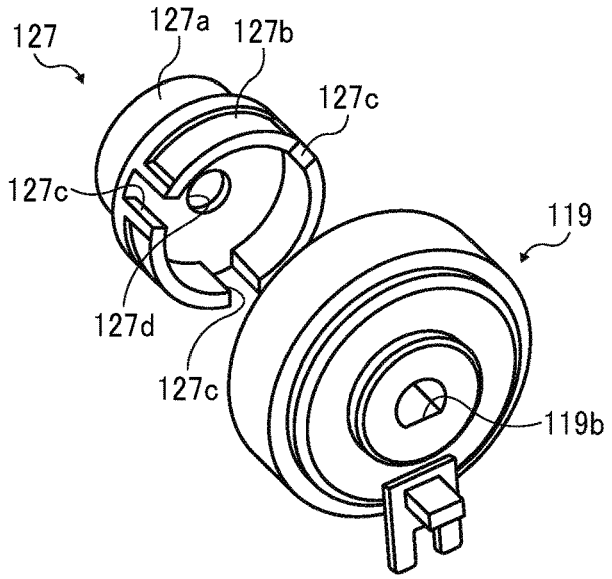
FIG. 7A is a perspective view illustrating a second conveyance pulley and a conveyance electromagnetic clutch, viewed from the conveyance electromagnetic clutch.
Figure 7B:
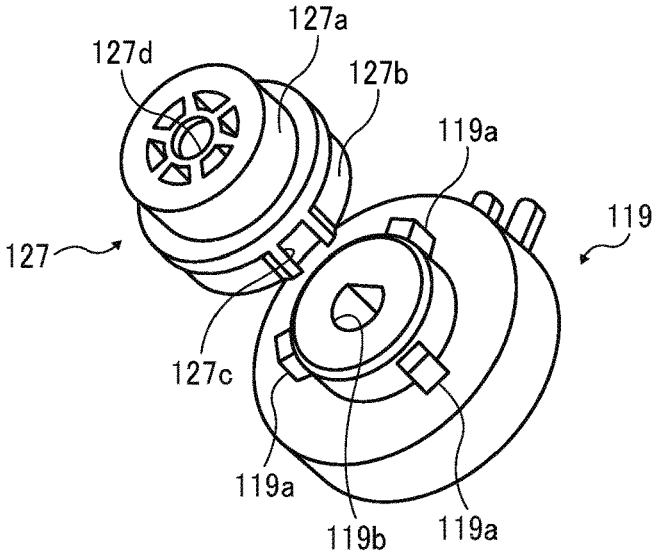
FIG. 7B is a perspective view illustrating the second conveyance pulley and the conveyance electromagnetic clutch, viewed from the second conveyance pulley.

FIGS. 7A and 7B are perspective views illustrating the second conveyance pulley 127 and the conveyance electromagnetic clutch 119. FIG. 7A is viewed from the conveyance electromagnetic clutch 119 and FIG. 7B is viewed from the second conveyance pulley 127.

As illustrated in FIGS. 7A and 7B, the second conveyance pulley 127 includes a pulley portion 127*a* around which the sheet conveyance timing belt 118 is wound, and a cylindrical or tubular engaging portion 127*b* that engages with the conveyance electromagnetic clutch 119. The engaging portion 127*b* is provided with three notches 127*c* that are formed at regular intervals in the circumferential direction of the second conveyance pulley 127. As illustrated in FIG. 7B, the conveyance electromagnetic clutch 119 has a small diameter portion on a side of the second conveyance pulley 127. The conveyance electromagnetic clutch 119 also has three engagement projections 119*a*, each of which projects in the normal direction from the outer peripheral surface of the small diameter portion of the conveyance electromagnetic clutch 119, at regular intervals in the circumferential direction.

The engagement projections 119*a* of the conveyance electromagnetic clutch 119 are respectively inserted into the notches 127*c* of the second conveyance pulley 127, so that the second conveyance pulley 127 and the conveyance electromagnetic clutch 119 are drivingly coupled to each other.

The conveyance electromagnetic clutch 119 includes an insertion hole 119*b* into which the shaft of the first pair of sheet conveying rollers 41 is inserted. The insertion hole 119*b* has a D-shape cross section. The shaft of the first pair of sheet conveying rollers 41 includes a notched portion having a D-shape cross section so as to be fitted and inserted into the insertion hole 119*b* having the D-shape cross section. The portion having a D-shape cross section extends to the end of the shaft of the first pair of sheet conveying rollers 41. The insertion hole 119*b* of the D-shape cross section is fitted and inserted into the portion having a D-shape cross section of the shaft of the first pair of sheet conveying rollers 41. By so doing, the driving force is transmitted to the shaft of the first pair of sheet conveying rollers 41 via the conveyance electromagnetic clutch 119.

By contrast, the second conveyance pulley 127 includes an insertion hole 127*d* into which the shaft of the first pair of sheet conveying rollers 41 of the second conveyance pulley 127 is inserted. The insertion hole 127*d* has a circular cross shape. The second conveyance pulley 127 is rotatably supported on the shaft of the first pair of sheet conveying rollers 41.

The driving force of the drive motor 101 that is transmitted to the sheet feed side drive input member 114 is input to the conveyance electromagnetic clutch 119 through the first sheet feed branch drive member 115, the second sheet feed branch drive member 117, the sheet conveyance timing belt 118 and the second conveyance pulley 127. When the sheet set on the sheet tray 20 is fed, the conveyance electromagnetic clutch 119 is turned ON to transmit the driving force to the first pair of sheet conveying rollers 41 via the conveyance electromagnetic clutch 119. By so doing, the first pair of sheet conveying rollers 41 is rotated. Accordingly, the sheet fed from the sheet tray 20 is conveyed toward the pair of registration rollers 49 by the first pair of sheet conveying rollers 41.

At a time when the leading end of the sheet comes into contact with the pair of registration rollers 49, the conveyance electromagnetic clutch 119 is turned OFF to interrupt the rotation of the first pair of sheet conveying rollers 41. Then, the pair of registration rollers 49 is driven. At a time when the sheet is conveyed to the transfer nip region, the conveyance electromagnetic clutch 119 is turned ON to resume the driving of the first pair of sheet conveying rollers 41. After the sheet is ejected to the outside of the apparatus body 50 of the image forming apparatus 1000, the conveyance electromagnetic clutch 119 is turned OFF to interrupt the driving of the first pair of sheet conveying rollers 41.

In the present embodiment, a timing belt is used to perform drive transmission from the second sheet feed branch drive member 117 to the first pair of sheet conveying rollers 41. According to this configuration, the drive device 100 can reduce the number of meshing positions of teeth of the gears when compared with a comparative drive device that uses gears for drive transmission. Accordingly, the level of noise (an engagement sound) generated due to meshing of gears can be reduced.

Figure 8A:
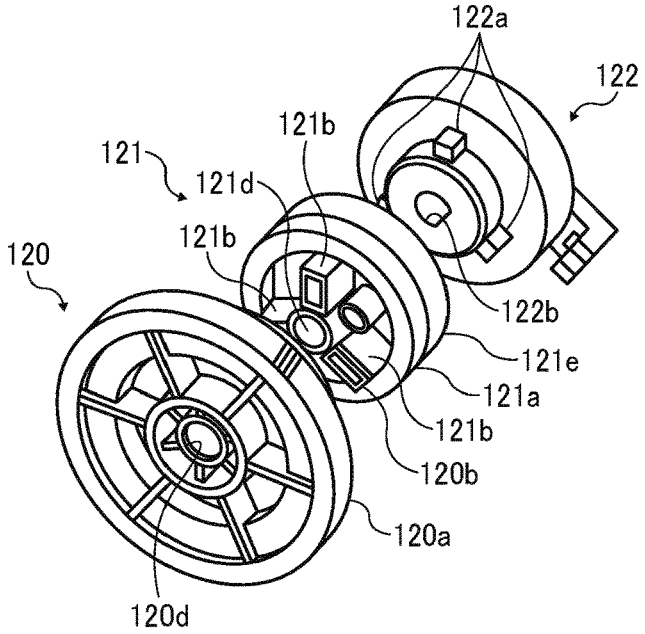
FIG. 8A is a perspective view illustrating a bypass supply branch drive member, an elevation branch gear and a bypass electromagnetic clutch, viewed from the bypass supply branch drive member (from inside of the drive device)
Figure 8B:
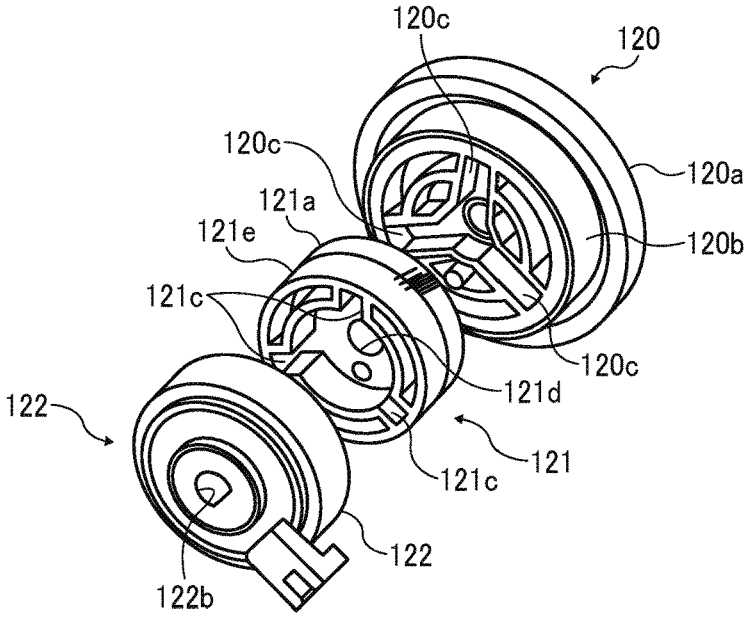
FIG. 8B is a perspective view illustrating a bypass supply branch drive member, an elevation branch gear and a bypass electromagnetic clutch, viewed from the bypass electromagnetic clutch (from outside of the drive device)

As illustrated in FIGS. 2 to 6, the bypass supply output gear 117*b* of the second sheet feed branch drive member 117 meshes with a bypass supply input gear 120*a* of a bypass supply branch drive member 120. The bypass supply branch drive member 120 includes a supply output gear 120*b*, and the supply output gear 120*b* meshes with a collection supply branch gear 128. The bypass supply branch drive member 120 is rotatably supported by the shaft of the bypass sheet feed roller 43*c*. A bypass electromagnetic clutch 122 and an elevation branch gear 121 are mounted on the shaft of the bypass sheet feed roller 43*c*, as illustrated in FIGS. 8A and 8B. The bypass electromagnetic clutch 122 functions as a drive switching device to switch a state of transmission of a driving force applied by the drive motor 101 between a transmission state in which the driving force of the drive motor 101 is transmitted and a halting state in which transmission of the driving force of the drive motor 101 is halted.

FIGS. 8A and 8B are perspective views illustrating the bypass supply branch drive member 120, which is provided on the shaft of the bypass sheet feed roller 43*c*, the elevation branch gear 121 and the bypass electromagnetic clutch 122. FIG. 8A is viewed from the bypass supply branch drive member 120 (from a center side in an axial direction of the rotary members provided in the apparatus body 50 of the image forming apparatus 1000). FIG. 8B is viewed from the bypass electromagnetic clutch 122 (from an end side in the axial direction of the rotary members provided in the apparatus body 50 of the image forming apparatus 1000). Hereinafter, the center side in the axial direction of the rotary members provided in the apparatus body 50 of the image forming apparatus 1000 is referred to as an "axially inner side of the apparatus body 50". Similarly, the end side in the axial direction of the rotary members provided in the apparatus body 50 of the image forming apparatus 1000 is referred to as an "axially outer side of the apparatus body 50".

On the shaft of the bypass sheet feed roller 43*c*, the bypass supply branch drive member 120, the elevation branch gear 121, and the bypass electromagnetic clutch 122 are arranged in this order from the inside of the drive device 100 (i.e., from the axially inner side of the apparatus body 50). The bypass supply branch drive member 120 includes the bypass supply input gear 120*a*, the supply output gear 120*b* and three gear meshing grooves 120*c*.

As illustrated in FIG. 8B, the three gear meshing grooves 120*c* are provided at each interval having an angle of 120 degrees in the rotation direction, on a surface of the bypass supply branch drive member 120 where the bypass supply branch drive member 120 and the elevation branch gear 121 face each other. Each of the three gear meshing grooves 120*c* extends in the normal direction from the center of rotation of the bypass supply branch drive member 120.

The elevation branch gear 121 includes a gear portion 121*a*, three gear meshing projections 121*b* and a cylindrical engaging portion 121*e*. As illustrated in FIG. 8A, the three gear meshing projections 121*b* are provided on a surface that faces the bypass supply branch drive member 120, at each interval having an angle of 120 degrees in the rotation direction. Each of the three gear meshing projections 121*b* extends in the normal direction from the rotation center of the elevation branch gear 121. Further, as illustrated in FIG. 8B, three clutch engaging grooves 121*c* are provided on the inner peripheral surface of an engaging portion 121*e* at an interval having an angle of 120 degrees in the rotation direction.

The bypass electromagnetic clutch 122 has a configuration similar to the configuration of the conveyance electromagnetic clutch 119 illustrated in FIGS. 7A and 7B. That is, three engagement projections 122*a* are provided at regular intervals in the circumferential direction of the bypass electromagnetic clutch 122. Each of the engagement projections 122*a* of the bypass electromagnetic clutch 122 projects in the normal direction from the outer peripheral surface of the small diameter portion of the bypass electromagnetic clutch 122.

The gear meshing grooves 120*c* of the bypass supply branch drive member 120 are respectively inserted into the gear meshing projections 121*b* of the elevation branch gear 121, the bypass supply branch drive member 120 and the elevation branch gear 121 are drivingly coupled to each other. Accordingly, the driving force is transmitted from the bypass supply branch drive member 120 to the elevation branch gear 121. By inserting the engagement projections 122*a* of the bypass electromagnetic clutch 122 into the respective clutch engaging grooves 121*c* of the elevation branch gear 121, the bypass electromagnetic clutch 122 couples the bypass supply branch drive member 120 via the elevation branch gear 121.

Further, the bypass electromagnetic clutch 122 has an insertion hole 122*b* into which the shaft of the bypass sheet feed roller 43*c* is inserted. The insertion hole 122*b* has a D-shape cross section. The portion having a D-shape cross section of the shaft of the notched bypass sheet feed roller 43*c* is fitted and inserted into the insertion hole 119*b* to transmit the driving force to the shaft of the bypass sheet feed roller 43*c* via the bypass electromagnetic clutch 122.

By contrast, the bypass supply branch drive member 120 has an insertion hole 120*d* into which the shaft of the bypass sheet feed roller 43*c* is inserted and the elevation branch gear 121 has an insertion hole 121*d* into which the shaft of the bypass sheet feed roller 43*c* is inserted. Both of the insertion hole 120*d* and the insertion hole 121*d* have a circular cross section and are rotatably supported on the shaft of the bypass sheet feed roller 43*c*.

For transmitting the driving force to the elevation branch gear 121, a configuration in which the second sheet feed branch drive member 117 is provided with a gear portion that meshes with the elevation branch gear 121 so as to transmit the driving force from the second sheet feed branch drive member 117 may be employed. However, in this configuration, noise (an engagement sound) is generated due to meshing of the elevation branch gear 121 and the gear portion of the second sheet feed branch drive member 117. In addition, the diameter of the elevation branch gear 121 is increased in size in order to obtain a desired reduction ratio. Therefore, it is likely that the elevation branch gear 121 interferes with another gear.

By contrast, in the present embodiment, the elevation branch gear 121 engages with the bypass supply branch drive member 120, and the elevation branch gear 121 is rotated together with the bypass supply branch drive member 120 as a single unit, thereby transmitting the driving force from the bypass supply branch drive member 120. By performing the drive transmission by rotating the elevation branch gear 121 and the bypass supply branch drive member 120 together, noise generated due to meshing during drive transmission does not occur, which is different from a case in which the drive transmission is performed by meshing of the gear. Accordingly, the level of noise generated due to meshing of the gear can be reduced.

Further, the gear speed can be reduced between the bypass supply input gear 120*a* of the bypass supply branch drive member 120 and the bypass supply output gear 117*b* of the second sheet feed branch drive member 117. Therefore, the gear speed can be reduced to a desired speed without increasing the diameter of the elevation branch gear 121. Accordingly, the elevation branch gear 121 can be arranged without interfering with other gears.

Further, the bypass supply branch drive member 120 may be provided with an elevation branch gear portion to integrally form the bypass supply branch drive member 120 with the elevation branch gear. However, there is not a big difference between the number of teeth of the supply output gear 120*b* and the number of teeth of the elevation branch gear 121, and there is not a big difference between the outer diameter of the supply output gear 120*b* and the outer diameter of the elevation branch gear 121. Accordingly, it is difficult to form the elevation branch gear portion on the bypass supply branch drive member 120. Therefore, in the present embodiment, the bypass supply branch drive member 120 and the elevation branch gear 121 are formed as separate units, and the bypass supply branch drive member 120 and the elevation branch gear 121 mesh with each other to integrally rotate the bypass supply branch drive member 120 and the elevation branch gear 121.

When the elevation branch gear 121, the bypass supply branch drive member 120 and the bypass electromagnetic clutch 122 are arranged in this order from the inside of the drive device 100 (from the axially inner side of the apparatus body 50), the drive transmission can be performed directly to the bypass electromagnetic clutch 122 from the bypass supply branch drive member 120. However, when the elevation branch gear 121 is arranged on the axially inner side of the apparatus body 50, it is likely that an elevation drive transmission member 125 including a gear that meshes with the elevation branch gear 121 interferes with the conveyance electromagnetic clutch 119, as illustrated in FIG. 5. As described above, in the present embodiment, the elevation branch gear 121 cannot be arranged on the axially inner side of the apparatus body 50 than the bypass supply branch drive member 120 due to layout of the drive device 100.

Further, even when the bypass electromagnetic clutch 122, the bypass supply branch drive member 120 and the elevation branch gear 121 are arranged in this order from the axially inner side of the apparatus body 50, the drive transmission can be performed directly to the bypass electromagnetic clutch 122 from the bypass supply branch drive member 120. However, in this case, it is likely that a cord for supplying power to the bypass electromagnetic clutch 122 is hooked on a gear or the like.

In order to address this inconvenience, the bypass electromagnetic clutch 122 is preferably arranged on the axially outer side of the apparatus body 50, in other words, on the shaft end side of the apparatus body 50. For the reasons described above, in the present embodiment, the bypass supply branch drive member 120, the elevation branch gear 121 and the bypass electromagnetic clutch 122 are arranged in this order from the inner side of the drive device 100.

Further, the elevation branch gear 121 and the bypass electromagnetic clutch 122 are drivingly coupled to each other and the driving force that is input to the bypass supply branch drive member 120 is input to the bypass electromagnetic clutch 122 via the elevation branch gear 121. According to this configuration, when the bypass electromagnetic clutch 122 is ON (activated), the driving force is transmitted to the bypass sheet feed roller 43*c*, thereby rotating the bypass sheet feed roller 43*c*.

As illustrated in FIGS. 2 through 6, the elevation branch gear 121 meshes with an elevation relay gear 125*a* of the elevation drive transmission member 125, and a gear of an elevation electromagnetic clutch 126 mounted on the shaft of the elevating member 43*b* meshes with an elevation output gear 125*b* of the elevation drive transmission member 125.

The driving force of the drive motor 101 that is transmitted to the sheet feed side drive input member 114 is transmitted to each of the first sheet feed branch drive member 115, the second sheet feed branch drive member 117 and the bypass supply branch drive member 120. Further, the driving force is transmitted to the bypass electromagnetic clutch 122 via the elevation branch gear 121. The driving force is then transmitted to the elevation electromagnetic clutch 126 via the elevation branch gear 121 and the elevation drive transmission member 125.

When a sheet set on the bypass tray 43 is fed, the elevation electromagnetic clutch 126 described above is turned ON to drive the elevating member 43*b* so as to lift the base plate 43*a* of the bypass tray 43. When the sheet placed on the base plate 43*a* comes into contact with the bypass sheet feed roller 43*c*, the elevation electromagnetic clutch 126 is turned OFF to interrupt driving of the elevating member 43*b*. Then, the bypass electromagnetic clutch 122 is turned ON to transmit the driving force of the drive motor 101 to the bypass sheet feed roller 43*c* to rotate the bypass sheet feed roller 43*c*. By so doing, the sheet set on the bypass tray 43 is fed toward the pair of registration rollers 49. When the leading end of the sheet fed from the bypass tray 43 comes into contact with the pair of registration rollers 49, the bypass electromagnetic clutch 122 is turned OFF to temporarily stop the rotation of the bypass sheet feed roller 43*c*. At a time when the registration electromagnetic clutch 124 is switched from OFF to ON, the bypass electromagnetic clutch 122 is turned ON to resume the rotation of the bypass sheet feed roller 43*c*. Accordingly, the sheet is conveyed to the transfer nip region by the pair of registration rollers 49 and the bypass sheet feed roller 43*c*.

After the trailing end of the sheet has passed through the bypass sheet feed roller 43*c*, the bypass electromagnetic clutch 122 is turned OFF to interrupt the rotation of the bypass sheet feed roller 43*c*. After feeding of the sheet from the bypass tray 43 is finished, the elevation electromagnetic clutch 126 is turned ON to cause the base plate 43*a* of the bypass tray 43 to descend. When the base plate 43*a* descends to a predetermined position, the elevation electromagnetic clutch 126 is turned OFF.

A supply input gear 130 and a supply electromagnetic clutch 129 are provided coaxially with the collection supply branch gear 128 that meshes with the supply output gear 120*b* of the bypass supply branch drive member 120. The collection supply branch gear 128 meshes with a collection output gear 134 that rotates integrally with a collection joint 135 that is drivingly coupled to the waste toner collection screw 11.

The driving force of the drive motor 101 that is transmitted to the sheet feed side drive input member 114 is transmitted to each of the first sheet feed branch drive member 115, the second sheet feed branch drive member 117 and the bypass supply branch drive member 120. Further, the driving force is transmitted to the waste toner collection screw 11 via the collection supply branch gear 128, the collection output gear 134 and the collection joint 135, thereby rotating the waste toner collection screw 11.

Figure 9A:
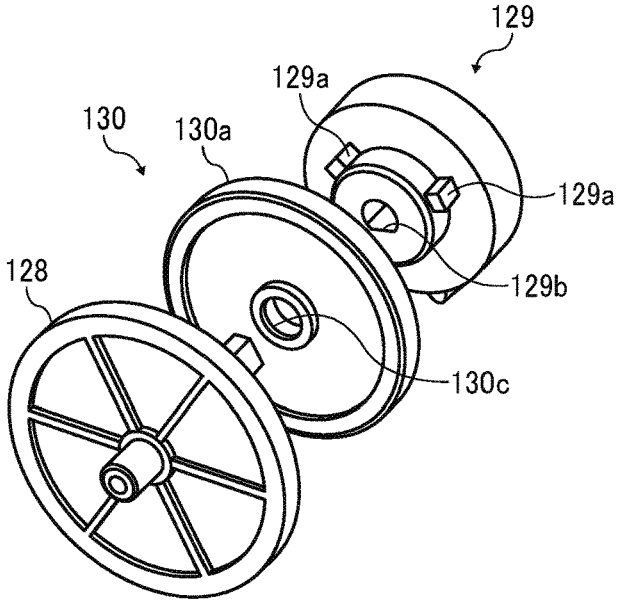
FIG. 9A is a perspective view illustrating a collection supply branch gear, a supply input gear and a supply electromagnetic clutch, viewed from the collection supply branch gear (from the inside of the drive device)
Figure 9B:
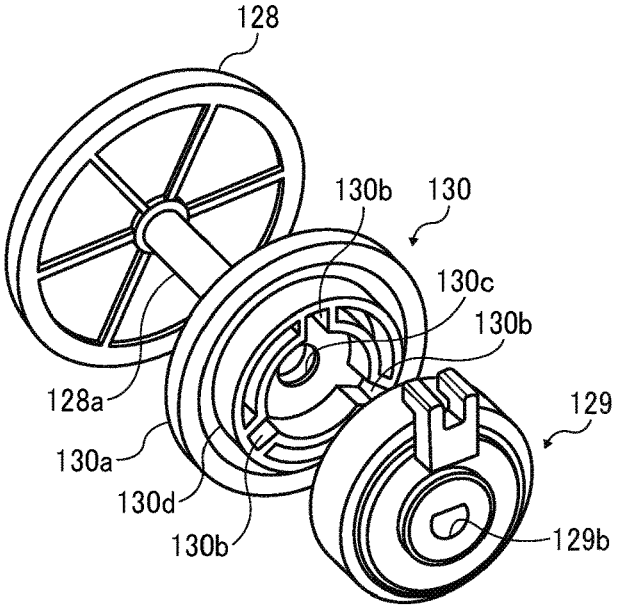
FIG. 9B is a perspective view illustrating the collection supply branch gear, the supply input gear and the supply electromagnetic clutch, viewed from the supply electromagnetic clutch (from the outside of the drive device)

FIGS. 9A and 9B are perspective views illustrating the collection supply branch gear 128, the supply input gear 130 and the supply electromagnetic clutch 129. FIG. 9A is viewed from the collection supply branch gear 128 (from the axially inner side of the apparatus body 50). FIG. 9B is a perspective viewed from the supply electromagnetic clutch 129 (from the axially outer side of the apparatus body 50).

The collection supply branch gear 128 includes a shaft 128*a*. The supply input gear 130 is rotatably supported on the shaft 128*a* of the collection supply branch gear 128.

The supply electromagnetic clutch 129 is attached to the shaft 128*a* so as to rotate together with the shaft 128*a* of the collection supply branch gear 128.

The supply input gear 130 includes a gear portion 130*a* and cylindrical engaging portions 130*d*. Three clutch engaging grooves 130*b* are provided at each interval of an angle of 120 degrees in the rotation direction on the inner peripheral surface of the engaging portion 130*d*.

The supply electromagnetic clutch 129 has a configuration basically identical to the conveyance electromagnetic clutch 119 and the bypass electromagnetic clutch 122. Specifically, three engagement projections 129*a* are provided at regular intervals in the circumferential direction of the supply electromagnetic clutch 129. Each of the engagement projections 129*a* projects in the normal direction from the outer peripheral surface of the small diameter portion of the supply electromagnetic clutch 129.

The engagement projections 129*a* of the supply electromagnetic clutch 129 are respectively fitted and inserted into the clutch engaging grooves 130*b* of the supply input gear 130. By so doing, the supply electromagnetic clutch 129 is drivingly coupled to the supply input gear 130.

The leading end of the shaft 128*a* of the collection supply branch gear 128 has a D-shape cross section. The leading end having a D-shape cross section is inserted into an insertion hole 129*b* having a D-shape cross section of the supply electromagnetic clutch 129 to transmit the driving force from the shaft 128*a* of the collection supply branch gear 128 to the supply electromagnetic clutch 129. By contrast, the supply input gear 130 has an insertion hole 130*c* having a circular cross section. The insertion hole 130*c* of the supply input gear 130 is rotatably supported on the shaft 128*a* of the collection supply branch gear 128. When the supply electromagnetic clutch 129 is ON (activated), the driving force is transmitted from the shaft 128*a* to the supply input gear 130 via the supply electromagnetic clutch 129.

As illustrated in FIGS. 2 through 6, the supply input gear 130 meshes with a supply relay gear 131*a* of a supply drive transmission member 131. The supply drive transmission member 131 includes a supply output gear 131*b*, and the supply output gear 131*b* meshes with a supply output gear 132 that rotates integrally with a supply joint 133 that is drivingly coupled to the toner supply member 9*c*.

The driving force of the drive motor 101 that is transmitted to the sheet feed side drive input member 114 is transmitted to each of the first sheet feed branch drive member 115, the second sheet feed branch drive member 117 and the bypass supply branch drive member 120. Further, the driving force is transmitted to the supply electromagnetic clutch 129 via the collection supply branch gear 128. Further, the driving force is transmitted to the supply electromagnetic clutch 129 via the collection supply branch gear 128.

When the supply electromagnetic clutch 129 is turned ON in response to a supply operation signal output from the controller, the driving force of the drive motor 101 is transmitted to the supply input gear 130 via the supply electromagnetic clutch 129. The driving force of the drive motor 101 is transmitted to the toner supply member 9*c* via the supply drive transmission member 131, the supply output gear 132 and the supply joint 133, so as to rotate the toner supply member 9*c*. By so doing, toner is supplied to the developing device 8.

The toner supply member 9*c* is provided with an agitating gear 137 to transmit the driving force to the agitators 9*a* and 9*b* (see FIG. 2). The driving force is transmitted to the agitators 9*a* and 9*b* via the agitating gear 137, and the agitators 9*a* and 9*b* are rotated together with the toner supply member 9*c*. When the amount of toner corresponding to the amount of rotation of the toner supply member 9*c* is supplied to the developing device 8, the supply electromagnetic clutch 129 is turned OFF.

In the drive device 100 according to the present embodiment, each electromagnetic clutch is provided to respective drive transmission passages extending to the second sheet reentry roller 48*b*, the third sheet reentry roller 48*c*, the pair of registration rollers 49, the first pair of sheet conveying rollers 41, the sheet feed roller 35, the bypass sheet feed roller 43*c*, the toner supply member 9*c* and the elevating member 43*b*. Specifically, the bypass electromagnetic clutch 122 that functions as a drive switching device is provided to a drive transmission passage PA1 to the bypass sheet feed roller 43*c* (see FIG. 6). The elevation electromagnetic clutch 126 is provided to a drive transmission passage PA2 to the elevating member 43*b* (see FIG. 5). The conveyance electromagnetic clutch 119 is provided to a belt drive transmission passage PA3 to the first pair of sheet conveying rollers 41 (see FIG. 6). The supply electromagnetic clutch 129 is provided to a drive transmission passage PA5 to the toner supply member 9*c* and the waste toner collection screw 11 (see FIG. 5). Consequently, without interrupting the driving of the drive device 100, the rotations of the second sheet reentry roller 48*b*, the third sheet reentry roller 48*c*, the pair of registration rollers 49, the first pair of sheet conveying rollers 41, the sheet feed roller 35, the bypass sheet feed roller 43*c*, the toner supply member 9*c* and the elevating member 43*b* can be interrupted or started at each predetermined time. According to this configuration, the fixing roller 44*a* that is constantly rotated and the rotary members that perform interruption and start of driving at a predetermined time (i.e., the second sheet reentry roller 48*b*, the third sheet reentry roller 48*c*, the pair of registration rollers 49, the first pair of sheet conveying rollers 41, the sheet feed roller 35, the bypass sheet feed roller 43*c*, the toner supply member 9*c* and the elevating member 43*b*) can be driven by a single motor, i.e., the drive motor 101. Accordingly, the number of motors can be reduced, and therefore the drive device 100 and the image forming apparatus 1000 can achieve a reduction in cost. By reducing the number of motors, the level of noise of the motors can be restrained, thereby effectively achieving noise reduction in a drive device and an image forming apparatus.

However, when an electromagnetic clutch is turned OFF to stop driving or is turned ON to start driving, a rapid load variation occurs the electromagnetic clutch. The rapid load variation becomes an impact to the electromagnetic clutch, and therefore the electromagnetic clutch vibrates the drive transmission member that transmits the driving force to the electromagnetic clutch. This vibration is propagated to the fixing roller 44*a*, a rotation unevenness occurs on the fixing roller 44*a*, which is likely to cause a fixing unevenness.

In order to address this inconvenience, in the present embodiment, the respective torques of the rotary members (i.e., the second sheet reentry roller 48*b*, the third sheet reentry roller 48*c*, the pair of registration rollers 49, the first pair of sheet conveying rollers 41, the sheet feed roller 35, the bypass sheet feed roller 43*c*, the toner supply member 9*c* and the elevating member 43*b*), each of which include an electromagnetic clutch in the drive transmission passage, are set to be lower than the torque of the fixing roller 44*a*, so that the load variation of the electromagnetic clutch can be restrained (absorbed) at the time of switching ON/OFF of the electromagnetic clutch.

in the present embodiment, the respective torques of the sheet feed roller 35, the first pair of sheet conveying rollers 41, the pair of registration rollers 49, the toner supply member 9*c*, the bypass sheet feed roller 43*c* and the elevating member 43*b*, which function as the rotary member that transmits the driving force via the electromagnetic clutch held by the sheet feed side bracket 100*b*, are set to be equal to or lower than one quarter (¼) of the torque of the fixing roller 44*a*. By lowering the torque of the rotary member including the electromagnetic clutch in the drive transmission passage, a load variation of the electromagnetic clutch can be restrained (absorbed) when the electromagnetic clutch is turned OFF to stop driving, or when the electromagnetic clutch is turned ON to start driving. Consequently, the level of an impact caused to the electromagnetic clutch when the electromagnetic clutch is turned OFF to stop driving or when the electromagnetic clutch is turned ON to start driving can be lowered, thereby reducing the level of vibration of the drive transmission member caused due to the impact.

The sheet feed side bracket 100*b* includes six electromagnetic clutches, i.e., the sheet feed electromagnetic clutch 116, the conveyance electromagnetic clutch 119, the registration electromagnetic clutch 124, the elevation electromagnetic clutch 126, the supply electromagnetic clutch 129 and the bypass electromagnetic clutch 122. An impact is caused when the drive transmission state of these electromagnetic clutches is switched, and the impact becomes vibration. However, in the present embodiment, a driving force is transmitted to the drive transmission members of the sheet feed side bracket 100*b* by a belt member using the sheet ejection side timing belt 111 or the link timing belt 113. By so doing, when vibration is generated when the electromagnetic clutch held by the sheet feed side bracket 100*b* switches the drive transmission state, the vibration is transmitted to the drive transmission members of the sheet feed side bracket 100*b* via the link timing belt 113 and the sheet ejection side timing belt 111.

The link timing belt 113 and the sheet ejection side timing belt 111 include an elastic member such as rubber. Accordingly, when the vibration is transmitted to the link timing belt 113 and the sheet ejection side timing belt 111, the belts are elastically deformed and the vibrational component is attenuated. Consequently, the propagation of the vibration generated in the sheet feed side bracket 100*b* to the sheet ejection side drive transmission members can be restrained, and therefore a rotation unevenness of the fixing roller 44*a* can be restrained.

In the present embodiment, the sheet feed side vibration can be attenuated in two stages, which are by the link timing belt 113 and the sheet ejection side timing belt 111.

In the present embodiment, the motor gear 101*a* of the drive motor 101 meshes with the first branching gear 102 that transmits the driving force to the fixing roller 44*a* and with the second branching gear 109 that transmits the driving force to the drive transmission member held by the sheet feed side bracket 100*b*. At the drive motor 101, a fixing drive transmission passage PA4 that leads to the fixing roller 44*a* (see FIG. 6) and the drive transmission passages that leads to the drive transmission member held by the sheet feed side bracket 100*b*, including the drive transmission passages PA1, PA2, PA3 and PA5, are branched.

As the drive motor 101, a drive motor having a rated torque equal to or greater than a torque determined based on the torque of the rotary member rotated by the drive motor 101 and a predetermined factor of safety is used. The drive motor 101 used in the present embodiment is a drive motor having a rated torque that is equal to or greater than a torque determined based on the total torque of the torques of the fixing roller 44*a*, the second sheet reentry roller 48*b*, the third sheet reentry roller 48*c*, the pair of registration rollers 49, the first pair of sheet conveying rollers 41, the elevating member 43*b*, the sheet feed roller 35, the bypass sheet feed roller 43*c*, the waste toner collection screw 11 and the toner supply member 9*c* and the predetermined factor of safety.

In the present embodiment, as described above, the respective torques of the rotary members (i.e., the sheet feed roller 35, the first pair of sheet conveying rollers 41, the pair of registration rollers 49, the toner supply member 9*c*, the bypass sheet feed roller 43*c* and the elevating member 43*b*) to which the driving force is transmitted from the drive transmission members held by the sheet feed side bracket 100*b* is equal to or smaller than one quarter (¼) of the torque of the fixing roller 44*a*. In addition, the load variation generated when the drive transmission state of the electromagnetic clutch is switched is considerably reduced with respect to the rated torque of the drive motor 101. As described above, the vibration is attenuated by the link timing belt 113 and the sheet ejection side timing belt 111 before being propagated to the motor gear 101*a*. Accordingly, the effect of the vibration generated when the drive transmission state of the electromagnetic clutch with respect to the output torque of the drive motor 101 is switched can be sufficiently reduced. Consequently, the vibrational component generated when the drive transmission state of the electromagnetic clutch that is held by the sheet feed side bracket 100*b* and propagated to the motor gear 101*a* is switched is smaller than the driving force of the drive motor 101.

Different from a gear, the motor gear 101*a* is rotated by the driving force generated by itself. Therefore, the vibration generated when the electromagnetic clutch held by the sheet feed side bracket 100*b* switches the drive transmission state is received by the driving force of the motor gear 101*a*. In addition, the vibrational component propagated to the motor gear 101*a* is smaller than the driving force, and therefore the motor gear 101*a*, can be continuously rotated at a constant speed without being vibrated by the vibrational component propagated to the motor gear 101*a*. By so doing, the propagation of the vibration to the first branching gear 102 via the motor gear 101*a* can be prevented. Accordingly, the fixing roller 44*a* can be prevented from vibrating due to the vibration that is generated when the electromagnetic clutch held by the sheet feed side bracket 100*b* switches the drive transmission state, and therefore the rotation unevenness of the fixing roller 44*a* can be restrained. Consequently, the occurrence of a fixing unevenness can be restrained.

Further, in the present embodiment, the drive transmission passage that leads to the fixing roller 44*a* is provided with the fixing timing belt 105 to transmit the driving force to the fixing roller 44*a* via the belt member. According to this configuration, even when the vibration is generated at the time of switching the drive transmission state of the reentry electromagnetic clutch 108 held by the sheet ejection side bracket 100*a*, the vibration is attenuated by elastically deforming the fixing timing belt 105. Consequently, the vibration propagated to the fixing roller 44*a* can be reduced and the rotation unevenness of the fixing roller 44*a* can be restrained.

Further, by reducing the respective torques of the rotary members (i.e., the second sheet reentry roller 48*b*, the third sheet reentry roller 48*c*, the pair of registration rollers 49, the first pair of sheet conveying rollers 41, the elevating member 43*b*, the sheet feed roller 35, the bypass sheet feed roller 43*c* and the toner supply member 9*c*) including the electromagnetic clutch in the drive transmission passage, the linking for driving can be achieved even with a weak electromagnetic force. Accordingly, an inexpensive small electromagnetic clutch can be used.

As described above, the process cartridge 30 and the toner cartridge 9 are attached to or detached from the right side surface of the apparatus body 50 of the image forming apparatus 1000, as illustrated in FIG. 1. Accordingly, in the present embodiment, the process cartridge 30 and the toner cartridge 9 are attached to or detached from the apparatus body 50 of the image forming apparatus 1000 by moving the process cartridge 30 and the toner cartridge 9 in a direction orthogonal to the axial direction of the apparatus body 50. Therefore, when the process cartridge 30 is removed from the apparatus body 50 of the image forming apparatus 1000, a photoconductor joint that is drivingly coupled to the photoconductor 1 is moved and retreated to a releasing position where the drive coupling is released, so that the process cartridge 30 can be removed from the apparatus body 50 of the image forming apparatus 1000.

When the toner cartridge 9 is removed from the apparatus body 50 of the image forming apparatus 1000, the supply joint 133 and the collection joint 135 are moved to the releasing position where the drive coupling is released to retreat the supply joint 133 and the collection joint 135.

When the process cartridge 30 is inserted into the apparatus body 50 of the image forming apparatus 1000, the photoconductor joint retreats to the releasing position so as not to come into contact with the process cartridge side joint.

Further, when the toner cartridge 9 is inserted into the apparatus body 50 of the image forming apparatus 1000, the supply joint 133 and the collection joint 135 are retreated to the releasing position.

Accordingly, the present embodiment includes a photoconductor releasing mechanism 210, a supply releasing mechanism 220 and a collection releasing mechanism 230. The photoconductor releasing mechanism 210 is a latent image moving mechanism that moves the photoconductor joint serving as a latent image link member between the drive coupling position and the releasing position. The supply releasing mechanism 220 is a moving mechanism that moves the supply joint 133 serving as a link body between the drive coupling position and the releasing position. The collection releasing mechanism 230 is a moving mechanism that moves the collection joint 135 serving as a link body between the drive coupling position and the releasing position.

Figure 10:
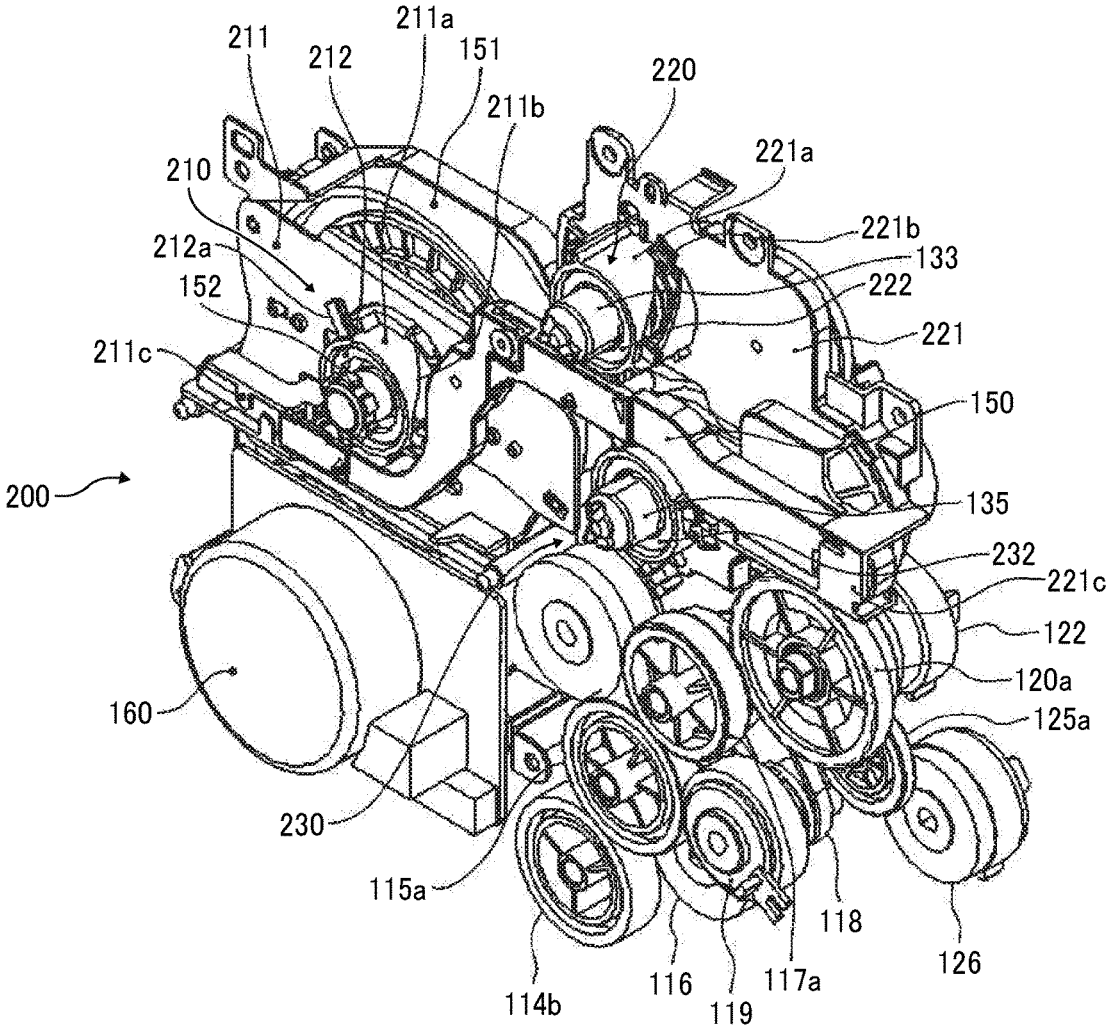
FIG. 10 is a perspective view illustrating a photoconductor releasing mechanism, a supply releasing mechanism, a collection releasing mechanism, a photoconductor drive device and a sheet feed side drive transmission member.
Figure 11:
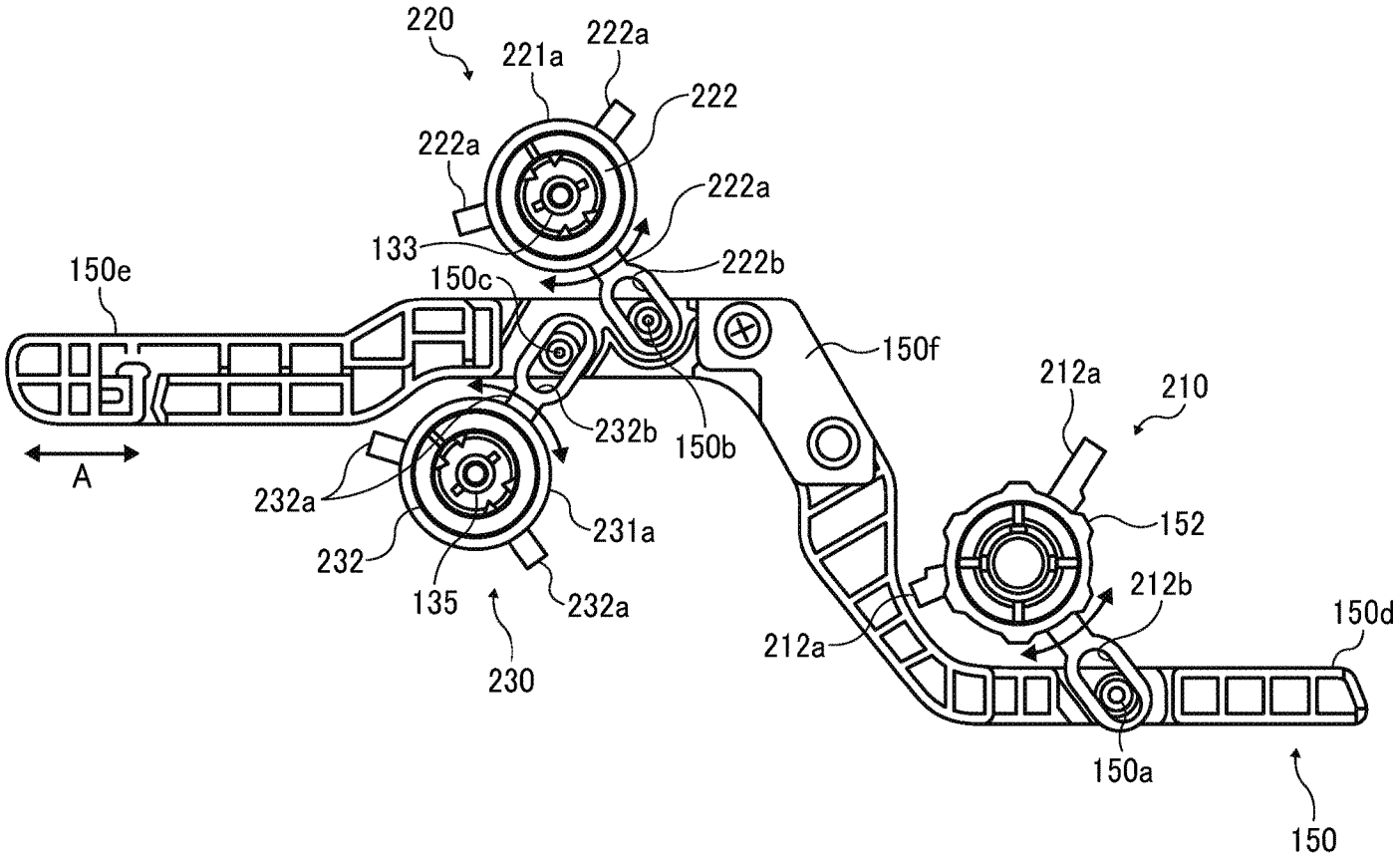
FIG. 11 is a diagram illustrating the photoconductor releasing mechanism, the supply releasing mechanism, the collection releasing mechanism, and a release lever.

FIG. 10 is a perspective view illustrating the photoconductor releasing mechanism 210, the supply releasing mechanism 220, the collection releasing mechanism 230, a photoconductor drive device 200 and a sheet feed side drive transmission member. FIG. 11 is a diagram illustrating the photoconductor releasing mechanism 210, the supply releasing mechanism 220, the collection releasing mechanism 230, and a releasing lever 150 serving as a driving body for driving these releasing mechanisms.

As illustrated in FIG. 10, the photoconductor drive device 200 is arranged between the sheet ejection side bracket 100*a* and the sheet feed side bracket 100*b*, which are illustrated in FIG. 2, and includes a photoconductor motor 160. The photoconductor drive device 200 includes a photoconductor gear 151 and a photoconductor joint 152. The photoconductor gear 151 is a gear to which the driving force of the photoconductor motor 160 is transmitted. The photoconductor joint 152 that is arranged coaxially with the photoconductor gear 151 and drivingly coupled to the joint, which is provided on the photoconductor side.

The photoconductor releasing mechanism 210 includes a holding member 211 that holds the photoconductor joint 152 so as to be movable in the axial direction. The holding member 211 includes a cylindrical portion 211*a*. The cylindrical portion 211*a* is provided with three notches 211*b* that are formed in the circumferential direction and located to be closer to the photoconductor gear 151 toward a downstream side of the counterclockwise direction in FIG. 10.

The cylindrical portion 211*a* holds a photoconductor joint moving member 212 that moves the photoconductor joint 152 between the drive linking position and the releasing position. The photoconductor joint moving member 212 includes a flat portion and has a through hole. The flat portion of the photoconductor joint moving member 212 extends perpendicular to the axial direction. The through hole is formed at the center of the flat portion to penetrate through the photoconductor joint 152.

The photoconductor joint moving member 212 further includes three guides 212*a* on the outer circumference thereof. The three guides 212*a*, each projecting in the radial direction, are provided at equal intervals in the rotation direction. These three guides 212*a* penetrate through the notches 211*b* that are formed on the outer circumference of the cylindrical portion 211*a*. One of the three guides 212*a* is provided with a through pass hole 222*b* through which a first projection 150*a* of the releasing lever 150 penetrates.

The photoconductor joint 152 is held by the photoconductor gear 151 and the holding member 211 so as to be movable in the axial direction.

A spring is provided between the photoconductor joint 152 and the photoconductor gear to bias the photoconductor joint 152 toward the photoconductor 1.

The photoconductor joint 152 is provided with an opposed portion that is opposed to the flat portion of the photoconductor joint moving member 212 from the photoconductor gear side. The opposed portion of the photoconductor joint 152 comes into contact with the flat portion of the photoconductor joint moving member 212, thereby preventing detachment of the photoconductor joint moving member 212 from the cylindrical portion of the photoconductor joint moving member 212 by a biasing force applied by the spring. Further, as described below, when the flat portion of the photoconductor joint moving member 212 presses the opposed portion of the photoconductor joint 152 toward the photoconductor gear side, thereby causing the photoconductor joint 152 to move from the drive coupling position to the releasing position.

It is to be noted that the supply releasing mechanism 220 and the collection releasing mechanism 230 also have a configuration similar to that of the photoconductor releasing mechanism. Specifically, the supply releasing mechanism 220 includes a holding member 221 that includes a cylindrical portion 221*a* provided with three notches 221*b* formed in the circumferential direction of the cylindrical portion 221*a*, and a moving member 222 that includes three guides 222*a* that respectively penetrate through the notches 221*b*. Similarly, the collection releasing mechanism 230 includes a holding member 231 that includes a cylindrical portion 231*a*, provided with three notches 231*b* formed in the circumferential direction of the cylindrical portion 231*a*, and a moving member 232 that includes three guides 232*a* that respectively penetrate through the notches 231*b*. One of the three guides 222*a* of the moving member 222 is provided with a through pass hole 222*b* through which a second projection 150*b* of the releasing lever 150 penetrate. Similarly, one of the three guides 232*a* of the moving member 232 is provided with a through pass hole 232*b* through which a third projection 150*c* of the releasing lever 150 penetrate.

As illustrated in FIG. 11, the releasing lever 150 includes a first lever 150*d* and a second lever 150*e*. The first lever 150*d* pivots the photoconductor joint moving member 212 of the photoconductor releasing mechanism 210. The second lever 150*e* pivots the moving member 222 of the supply releasing mechanism 220 and the moving member 232 of the collection releasing mechanism 230. The first lever 150*d* and the second lever 150*e* are linked by a lever link member 150*f*.

The releasing lever 150 moves in a direction indicated by arrow A in FIG. 11, in conjunction with opening and closing of the cover 50*b* (see FIG. 1) of the apparatus body 50 of the image forming apparatus 1000 by a link mechanism or the like.

As illustrated in FIG. 10, the holding member 221 of the supply releasing mechanism 220 includes a holding portion 221*c* to hold the releasing lever 150. Similarly, the holding member 211 of the photoconductor releasing mechanism 210 includes a holding portion 211*c* to hold the releasing lever 150. The releasing lever 150 is held on the holding portions 221*c* and 211*c* so as to be slidably movable. According to this configuration, by including the holding portions 221*c* and 211*c* on the holding member 221 of the supply releasing mechanism 220 and the holding member 211 of the photoconductor releasing mechanism 210 to hold the releasing lever 150, the number of parts can be reduced, when compared with a case in which a holding member is provided to hold the releasing lever 150. Accordingly, a reduction in cost of the drive device and the image forming apparatus can be enhanced.

Figure 12A:
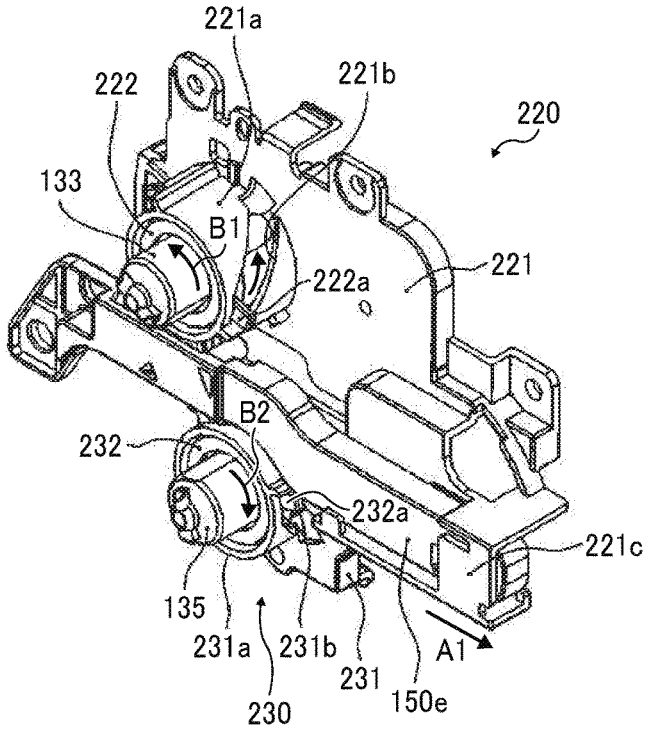
FIGS. 12A and 12B are diagrams illustrating operations of the supply releasing mechanism and the collection releasing mechanism.
Figure 12B:
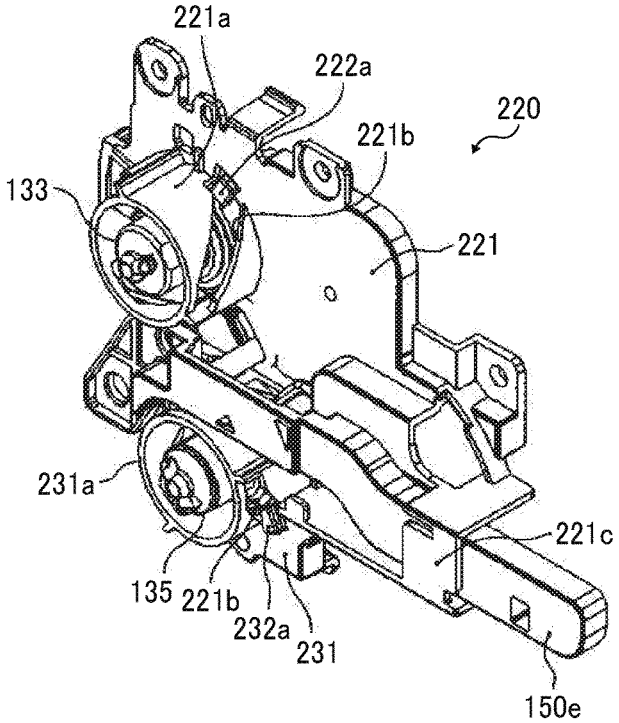

FIGS. 12A and 12B are diagrams illustrating operations of the supply releasing mechanism 220 and the collection releasing mechanism 230.

The releasing lever 150 moves in a direction indicated by arrow A1 in FIG. 12A, in conjunction with movement of the cover 50*b* of the apparatus body 50 of the image forming apparatus 1000 to an open position of the cover 50*b*. Then, the second projection 150*b* (see FIG. 11) of the releasing lever 150 presses the through pass hole 222*b* of the moving member of the supply releasing mechanism 220 in the direction indicated by arrow A1 in FIG. 12A. Then, the moving member 222 of the supply releasing mechanism 220 pivots in a direction indicated by arrow B1 in FIG. 12A (i.e., the counterclockwise direction in FIG. 12A). The guides 222*a* of the moving member 222 of the supply releasing mechanism 220 are then guided by the notches 221*b* and the moving member 222 moves into the cylindrical portion 221*a* while rotating. Then, the moving member 222 comes into contact with an opposed portion of the supply joint 133 that faces the moving member 222, so that the supply joint 133 is moved into the cylindrical portion 221*a*. Then, as illustrated in FIG. 12B, the supply joint 133 moves from the drive coupling position to the releasing position.

Further, the third projection 150*c* (see FIG. 11) of the releasing lever 150 presses a through pass hole 232*b* of the moving member of the collection releasing mechanism 230 in the direction indicated by arrow A1 in FIG. 12A. Then, as illustrated in FIG. 12A, the moving member 232 of the collection releasing mechanism 230 is pivoted in a direction indicated by arrow B2 in FIG. 12A (i.e., the clockwise direction in FIG. 12A). Then, each guide 232*a* of the moving member 232 of the collection releasing mechanism 230 is guided by each corresponding notch 231*b*, and the moving member 232 moves into the cylindrical portion 231*a* while rotating. Accordingly, the moving member 232 moves the collection joint 135 into the cylindrical portion 231*a*. Then, as illustrated in FIG. 12B, the collection joint 135 moves from the drive coupling position to the releasing position.

The photoconductor releasing mechanism 210 also moves the photoconductor joint 152 from the drive coupling position to the releasing position by the similar operation to the operation performed by the supply releasing mechanism 220 and the collection releasing mechanism 230.

Consequently, as the cover 50*b* (see FIG. 1) of the apparatus body 50 of the image forming apparatus 1000 is moved to the open position, the drive coupling of the photoconductor joint 152, the supply joint 133 and the collection joint 135 is released. Consequently, the process cartridge 30 and the toner cartridge 9 are moved in the direction orthogonal to the axial direction to be removed from a side surface of the apparatus body 50 in parallel with the axial direction.

Further, when the process cartridge 30 and the toner cartridge 9 are attached to the apparatus body 50, the cover 50*b* is located at the open position and the photoconductor joint 152, the supply joint 133 and the collection joint 135 are located at the releasing position. Accordingly, the photoconductor joint 152, the supply joint 133 and the collection joint 135 do not hinder the motion of attachment of the process cartridge 30 and the toner cartridge 9 to the apparatus body 50 of the image forming apparatus 1000.

When the cover 50*b* is moved to the closed position, the photoconductor joint moving member 212, the moving member 222 and the moving member 232 move the center in the axial direction of the rotary members provided to the apparatus body 50 (i.e., toward the axially inner side of the apparatus body 50) while being rotated. The photoconductor joint 152, the supply joint 133 and the collection joint 135 are biased to the center in the axial direction of the rotary members provided to the apparatus body 50 (i.e., toward the axially inner side of the apparatus body 50) by the spring. Therefore, when the photoconductor joint moving member 212, the moving member 222 and the moving member 232 move toward the center in the axial direction of the rotary members provided to the apparatus body 50 (i.e., toward the axially inner side of the apparatus body 50) while being rotated, the photoconductor joint 152, the supply joint 133 and the collection joint 135 are moved from the releasing position to the drive coupling position by the biasing force of the spring. Accordingly, when the cover 50*b* is dosed, the photoconductor joint 152, the supply joint 133 and the collection joint 135 are respectively drivingly coupled to the respective rotary members (i.e., the photoconductor 1, the toner supply member 9*c* and the waste toner collection screw 11), thereby transmitting the driving force to the corresponding rotary members.

This configurations according to the above-descried embodiments are not limited thereto. This disclosure can achieve the following aspects effectively.

Aspect 1.

A drive device (for example, the drive device 100) includes a drive source (for example, the drive motor 101), a drive switching device (for example, the bypass electromagnetic clutch 122), a first rotary body (for example, the bypass sheet feed roller 43*c*), a first drive transmission passage (for example, the drive transmission passage PA1), a second rotary body (for example, the elevating member 43*b*), a second drive transmission passage (for example, the drive transmission passage PA2), a drive transmission body (for example, the elevation branch gear 121), an input drive transmission body (for example, the bypass supply branch drive member 120). The drive source has a drive output body (for example, the motor gear 101*a*). The drive switching device is configured to switch between a transmission state in which a driving force applied by the drive source is transmitted and a halting state in which transmission of the driving force of the drive source is halted. The first rotary body has a rotary shaft to which the driving force is inputted via the drive switching device. The first drive transmission passage is a passage through which the driving force is transmitted to the first rotary body. The second drive transmission passage is a passage through which the driving force is transmitted to the second rotary body. The drive transmission body is rotatably mounted on the rotary shaft of the first rotary body. The input drive transmission body is mounted on the rotary shaft of the first rotary body and configured to input the driving force to the rotary shaft of the first rotary body, the input drive transmission body configured to rotate together with the drive transmission body as a single unit.

The meshing noise of gears is a noise generated in the drive device. The meshing sound of gears are generated due to the following reasons. A driving force is transmitted between gears by sequentially switching the teeth to be meshed. Therefore, when each tooth of the drive side gear contacts each tooth of the driven side gear, a sound is generated. This sound is taken as a noise.

By contrast, in Aspect 1, the drive transmission body that is rotatably supported by the rotary shaft in the second (different) drive transmission passage is rotated together with the input drive transmission body that is mounted on the same rotary shaft as a single unit. Accordingly, the driving force is transmitted from the input drive transmission body to the drive transmission body.

As described above, when the driving force is transmitted from the input drive transmission body to the drive transmission body, the input drive transmission body and the drive transmission body rotate integrally. Therefore, as the input drive transmission body rotates, the contact portion of the input drive transmission body with the drive transmission body does not change, that is, the same portions of the input drive transmission body constantly contact the drive transmission body when transmitting the driving force. Accordingly, when compared with the drive transmission between gears having a configuration in which the contact portions of a drive side transmission body and a driven side transmission body continuously change along with rotation of the drive side transmission body, the configuration of the embodiments described above can reduce the level of noise during drive transmission.

Aspect 2.

In Aspect 1, the input drive transmission body (for example, the bypass supply branch drive member 120) is rotatably supported by the rotary shaft of the first rotary body (for example, the bypass sheet feed roller 43*c*). Further, the first drive transmission body (for example, the elevation branch gear 121) includes a first engaging portion (for example, the gear meshing projections 121*b*) disposed between the input drive transmission body and the drive switching device (for example, the bypass electromagnetic clutch 122) in an axial direction of the first drive transmission body and configured to engage with the input drive transmission body, and a second engaging portion (for example, the clutch engaging grooves 121*c*) configured to engage with the drive switching device.

According to this configuration, as described in the embodiments above, due to the layout of the image forming apparatus 1000, there is no choice but the first drive transmission body (for example, the elevation branch gear 121) is disposed between the drive switching device (for example, the bypass electromagnetic clutch 122) and the input drive transmission body (for example, the bypass supply branch drive member 120). Even in this case, by engaging with the input drive transmission body by the first engaging portion (for example, the gear meshing projections 121*b*), the drive transmission body can be rotated with the input drive transmission body as a single unit, and therefore the driving force transmitted to the input drive transmission body can be further transmitted to the drive switching device via the first drive transmission body.

Aspect 3.

In Aspect 1 or Aspect 2, the drive device (for example, the drive device 100) further includes a second drive switching device (for example, the conveyance electromagnetic clutch 119) configured to switch between the transmission state and the halting state, a belt (for example, the sheet conveyance timing belt 118), a belt drive transmission passage (for example, the belt drive transmission passage PA3) through which the driving force of the drive source (for example, the drive motor 101) is transmitted to the second drive switching device (for example, in the present embodiment, the drive transmission passage through which the driving force is transmitted to the first pair of sheet conveying rollers 41), and a stretching body (for example, the second conveyance pulley 127) configured to stretch the belt. The second drive switching device and the stretching body are engaged with each other in an axial direction of the second drive switching device.

In Aspect 1 or Aspect 2, the drive device (for example, the drive device 100) further includes a second drive switching device (for example, the conveyance electromagnetic clutch 119) configured to switch between the transmission state and the halting state, a belt (for example, the sheet conveyance timing belt 118), a belt drive transmission passage through which the driving force of the drive source (for example, the drive motor 101) is transmitted to the second drive switching device (for example, in the present embodiment, the drive transmission passage through which the driving force is transmitted to the first pair of sheet conveying rollers 41), and a stretching body (for example, the second conveyance pulley 127) configured to stretch the belt. The second drive switching device and the stretching body are engaged with each other in an axial direction of the second drive switching device. Further, when the load variation occurs during transmission of the driving force to the second drive switching device, the load can be absorbed by elastically deforming the belt.

Accordingly, the load variation to the second drive switching device can be reduced, and therefore the durability of the second drive switching device can be enhanced.

Aspect 4.

In any one of Aspect 1 through Aspect 3, the drive device (for example, the drive device 100) further includes a fixing roller (for example, the fixing roller 44*a*), a fixing drive transmission passage (for example, the fixing drive transmission passage PA4) through which the driving force of the drive source is transmitted to the fixing roller, a fixing drive input body (for example, the first branching gear 102) configured to input the driving force first to the fixing drive transmission passage, and a drive input body (for example, the second branching gear 109) configured to input the driving force first to the first drive transmission passage. The fixing drive input body and the drive input body are meshed with the drive output body (for example, the motor gear 101*a*) of the drive source.

According to this configuration, as described in the embodiments above, the drive output body of the drive source is different from another drive transmission body such as a gear and is rotated by a driving force generated by itself at a constant speed. Therefore, the vibration generated by itself is received by the driving force of the motor gear, thereby being attenuated. Accordingly, the vibration generated when the drive switching device (for example, the bypass electromagnetic clutch 122) switches the drive transmission state can be restrained from being transmitted to the fixing drive transmission passage. Consequently, the non-uniformity of rotation of the fixing roller 44*a* can be restrained, and therefore the occurrence of fixing nonuniformity can be restrained.

Aspect 5.

In Aspect 4, the drive device (for example, the drive device 100) further includes a belt (for example, the link timing belt 113). The first drive transmission passage (for example, the drive transmission passage through which the driving force is transmitted to the bypass sheet feed roller 43*c*) is configured to transmit the driving force of the drive source (for example, the drive motor 101) to the input drive transmission body (for example, the bypass supply branch drive member 120) via the belt.

By so doing, the vibration that is generated in the first drive switching device (for example, the bypass electromagnetic clutch 122) is transmitted to the belt. The vibration transmitted to the belt is attenuated by elastically deforming the belt. Therefore, the vibration attenuated by the belt is transmitted to the drive output body (for example, the motor gear 101*a*) of the drive source.

Accordingly, the vibration can be received by the drive output body of the drive source. Therefore, the vibration generated when the first drive switching device switches the drive transmission state is further restrained from being transmitted to the fixing drive transmission passage. Consequently, the nonuniformity of rotation of the fixing roller 44*a* can be restrained, and therefore the occurrence of fixing nonuniformity can be restrained.

Aspect 6.

In any one of Aspect 1 through Aspect 5, the drive device (for example, the drive device 100) further includes a drive transmission passage (for example, the drive transmission passage through which the driving force is transmitted to the toner supply member 9*c* or the drive transmission passage through which the driving force is transmitted to the waste toner collection screw 11) includes a second drive transmission body, a link body (for example, the supply joint 133 and the collection joint 135) configured to move between a coupling position to be coupled to the second drive transmission body and a releasing position to be released from the second drive transmission body, and a moving device (for example, the supply releasing mechanism 220 and the collection releasing mechanism 230) configured to move the link body between the coupling position and the releasing position.

According to this configuration, as described in the embodiments above, the rotary body that is drivingly coupled by the link body is detached from and attached to the apparatus body in a direction perpendicular to the axial direction.

Aspect 7.

An image forming apparatus (for example, the image forming apparatus 1000) includes multiple rotary bodies and the drive device according to any one of Aspect 1 through Aspect 6, configured to transmit the driving force to the multiple rotary bodies.

Consequently, the level of noise of the image forming apparatus can be reduced.

Aspect 8.

In Aspect 7, the image forming apparatus (for example, the image forming apparatus 1000) further includes an image bearer (for example, the photoconductor 1), a developing device (for example, the developing device 8), a transfer device (for example, the transfer roller 10), a cleaning device (for example, the cleaning blade 2), a waste toner conveyance body (for example, the waste toner collection screw 11), and a toner supply body (for example, the toner supply member 9*c*). The image bearer is configured to bear an image on a surface thereof. The developing device is configured to develop the image borne on the surface of the image bearer with toner. The transfer device is configured to transfer the image on the image bear onto the recording medium. The cleaning device is configured to remove the toner remaining on the surface of the image bearer after the image is transferred by the transfer device. The waste toner conveyance body is configured to convey the toner removed by the cleaning device. The toner supply body is configured to supply toner to the developing device. The drive device is configured to transmit the driving force to a sheet conveying body of the multiple rotary bodies, the waste toner conveyance body and the toner supply body.

According to this configuration, by rotating the sheet conveying body, the waste toner conveyance body and the toner supply body by a single drive source, the number of drive sources can be reduced, and therefore can achieve a reduction in cost, when compared with a configuration in which the sheet conveying body, the waste toner conveyance body and the toner supply body are rotated by different drive sources. Further, the level of noise of the drive source can be reduced.

Aspect 9.

In Aspect 8, the image bearer (for example, the photoconductor 1) is rotated by a second drive source different from the drive source (for example, the drive motor 101) of the drive device (for example, the drive device 100).

According to this configuration, the vibration generated when the drive transmission state is changed by the first drive switching device can be restrained from being transmitted to the image bearer. Therefore, the nonuniformity of rotation of the image bearer can be restrained. Accordingly, occurrence of a defect image such as banding can be restrained.

Aspect 10.

In Aspect 9, the image forming apparatus (for example, the image forming apparatus 1000) further includes a drive transmission passage (for example, the drive transmission passage PA5), a third drive transmission body (for example, the photoconductor gear 151), a second moving device (for example, the photoconductor releasing mechanism 210) and a drive body (for example, the releasing lever 150). The drive transmission passage includes a second drive transmission body (for example, the supply output gear 132, the collection output gear 134), a first link body (for example, the supply joint 133 and the collection joint 135) and a first moving device (for example, the supply releasing mechanism 220 and the collection releasing mechanism 230). The first link body is configured to move between a first coupling position to be coupled to the second drive transmission body and a first releasing position to be released from the second drive transmission body. The first moving device is configured to move the first link body between the first coupling position and the first releasing position. The second moving device (for example, the photoconductor releasing mechanism 210) includes a second link body (for example, the photoconductor joint 152) configured to move between a second coupling position to be coupled to the third drive transmission body and a second releasing position to be released from the third drive transmission body and configured to move the second link body between the second coupling position and the second releasing position. The drive body is configured to drive together with the first moving device and the second moving device.

According to this configuration, the number of parts can be reduced when compared with the configuration in which a drive unit that drives the first moving device and a different drive unit that drives the second moving device are provided, and therefore a reduction in cost of the image forming apparatus.

Further, by operating the drive body, the coupling of the first link body and the second link body can be released. Accordingly, a unit including a rotary body that is drivingly coupled by the first link body (for example, the toner cartridge 9 in the present embodiment) and the image bearer can be enhanced in operability of attachment and detachment to the image forming apparatus.

Aspect 11.

In Aspect 10, the image forming apparatus (for example, the image forming apparatus 1000) further includes a holding portion (for example, the holding portions 221*c* and 211*c*) configured to hold the drive body (for example, the releasing lever 150) to the first moving device (for example, the supply releasing mechanism 220 and the collection releasing mechanism 230) and the second moving device (for example, the photoconductor releasing mechanism 210).

According to this configuration, as described in the embodiments above, the number of parts can be reduced, and therefore a reduction in cost of the image forming apparatus can be enhanced, when compared with a configuration in which a holding member to hold the drive body is provided.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A drive device comprising:

a drive source having a drive output body;

an electromagnetic clutch configured to switch between a transmission state in which a driving force applied by the drive source is transmitted and a halting state in which transmission of the driving force of the drive source is halted;

a first rotary body having a rotary shaft to which the driving force is inputted via the electromagnetic clutch;

a first drive transmission passage through which the driving force is transmitted to the first rotary body;

a second rotary body;

a second drive transmission passage through which the driving force is transmitted to the second rotary body;

a drive transmission body rotatably mounted on an outer surface of the rotary shaft of the first rotary body; and an input drive transmission body mounted coaxially with the drive transmission body on the outer surface of the rotary shaft of the first rotary body and configured to input the driving force to the rotary shaft of the first rotary body, the input drive transmission body configured to rotate together with the drive transmission body as a single unit regardless of whether the electromagnetic clutch is turned ON or OFF.

2. The drive device according to claim 1, wherein the input drive transmission body is rotatably supported by the rotary shaft of the first rotary body, and wherein the drive transmission body includes a first engaging portion as a projection on the drive transmission body and disposed between the input drive transmission body and the electromagnetic clutch in an axial direction of the drive transmission body and configured to engage with grooves in the input drive transmission body; and a second engaging portion configured to engage with the electromagnetic clutch.

3. The drive device according to claim 1, further comprising:

a second electromagnetic clutch configured to switch between the transmission state and the halting state;

a belt;

a belt drive transmission passage through which the driving force of the drive source is transmitted to the second electromagnetic clutch; and a stretching body configured to stretch the belt, wherein the second electromagnetic clutch and the stretching body are engaged with each other in an axial direction of the second electromagnetic clutch.

4. The drive device according to claim 1, further comprising:

a fixing roller;

a fixing drive transmission passage through which the driving force of the drive source is transmitted to the fixing roller;

a fixing drive input body configured to input the driving force to the fixing drive transmission passage; and a drive input body configured to input the driving force to the first drive transmission passage, wherein the fixing drive input body and the drive input body are meshed with the drive output body of the drive source.

5. The drive device according to claim 4, further comprising a belt, wherein the first drive transmission passage is configured to transmit the driving force to the input drive transmission body via the belt.

6. The drive device according to claim 1, further comprising a drive transmission passage including:

a second drive transmission body provided on an axially inner side;

a link body configured to move between a coupling position to be coupled to the second drive transmission body and a releasing position to be released from the second drive transmission body; and a moving device configured to move the link body between the coupling position and the releasing position.

7. An image forming apparatus comprising:

multiple rotary bodies configured to convey a recording medium; and the drive device according to claim 1, configured to transmit the driving force to the multiple rotary bodies.

8. The image forming apparatus according to claim 7, further comprising:

an image bearer configured to bear an image on a surface thereof;

a developing device configured to develop the image borne on the surface of the image bearer with toner;

a transfer device configured to transfer the image on the image bearer onto the recording medium;

a cleaning device configured to remove the toner remaining on the surface of the image bearer after the image is transferred by the transfer device;

a waste toner conveyance body configured to convey the toner removed by the cleaning device; and a toner supply body configured to supply toner to the developing device, wherein the drive device is configured to transmit the driving force to a sheet conveying body of the multiple rotary bodies, the waste toner conveyance body and the toner supply body.

9. The image forming apparatus according to claim 8, wherein the image bearer is rotated by a second drive source different from the drive source of the drive device.

10. The image forming apparatus according to claim 9, further comprising:

a drive transmission passage including:

a second drive transmission body;

a first link body configured to move between a first coupling position to be coupled to the second drive transmission body and a first releasing position to be released from the second drive transmission body; and a first moving device configured to move the first link body between the first coupling position and the first releasing position;

a third drive transmission body;

a second moving device including a second link body configured to move between a second coupling position to be coupled to the third drive transmission body and a second releasing position to be released from the third drive transmission body, the second moving device configured to move the second link body between the second coupling position and the second releasing position; and a drive body configured to drive together with the first moving device and the second moving device.

11. The image forming apparatus according to claim 10, further comprising a holding portion configured to hold the drive body to the first moving device and the second moving device.

* * * * *